US011718988B1

(12) United States Patent
Godfrey

(10) Patent No.: US 11,718,988 B1
(45) Date of Patent: Aug. 8, 2023

(54) CEILING GRID SYSTEM

(71) Applicant: Preston Godfrey, Westfield, MA (US)

(72) Inventor: Preston Godfrey, Westfield, MA (US)

( * ) Notice: Subject to any disclaimer, the term of this patent is extended or adjusted under 35 U.S.C. 154(b) by 0 days.

(21) Appl. No.: 18/113,881

(22) Filed: Feb. 24, 2023

Related U.S. Application Data

(63) Continuation-in-part of application No. 17/516,610, filed on Nov. 1, 2021, now Pat. No. 11,603,662.

(51) Int. Cl.
*E04B 9/10* (2006.01)

(52) U.S. Cl.
CPC ..... *E04B 9/10* (2013.01)

(58) Field of Classification Search
CPC . E04B 9/06; E04B 9/241; E04B 9/127; E04B 9/122; E04B 9/068; E04B 9/003; E04B 9/247
See application file for complete search history.

(56) References Cited

U.S. PATENT DOCUMENTS 5,137,390 A * 8/1992 Felsen ..... E04B 9/122 403/393
9,181,696 B1 * 11/2015 Bergman ..... E04B 9/18
9,187,896 B1 * 11/2015 Bergman ..... E04B 9/10
9,187,897 B1 * 11/2015 Bergman ..... E04B 9/26
2014/0069041 A1 * 3/2014 Sareyka ..... E04B 9/122 52/506.05
2015/0308112 A1 * 10/2015 Holdridge ..... E04B 9/0478 52/506.08

* cited by examiner

*Primary Examiner* — Gisele D Ford
(74) *Attorney, Agent, or Firm* — Richard Kosakowski

(57) ABSTRACT

A ceiling grid system as part of a suspended ceiling having a plurality of ceiling panels includes main runners and cross-runners oriented transverse to each other and forming a two-dimensional array having openings, each opening defining a position within the suspended ceiling in which a ceiling panel is disposed, the main runners and the cross-runners being configured to attach to each other and to be fixed in the horizontal plane in the physical space, each one of a plurality of panel support members is connected with a main runner or a cross-runner and is configured to support one of the ceiling panels, each panel support member is movable in a rotatable manner with respect to the main runner or the cross-runner to facilitate the installation or removal of one of the ceiling panel with respect to its predetermined position within the suspended ceiling.

20 Claims, 18 Drawing Sheets

CEILING GRID SYSTEM

CROSS-REFERENCE TO RELATED APPLICATIONS

The present application is a continuation-in-part application which claims the benefit of and domestic priority to U.S. patent application Ser. No. 17/516,610, filed Nov. 1, 2021, the contents of which are incorporated by reference herein.

FIELD OF THE INVENTION

The subject matter disclosed herein relates in general to ceiling grid systems for use as part of suspended ceilings that are installed in rooms, and more specifically to such a ceiling grid system with movable components which allow for relatively easy access to individual ceiling panels thereby facilitating the quicker and easier installation and removal of the ceiling panels and with much less chance of causing damage to the panels.

BACKGROUND OF THE INVENTION

Known, prior art ceiling grid systems are part of overall suspended ceilings (aka "drop ceilings") which are commonly installed, for example, in rooms inside residences and commercial office spaces or in other physical spaces. These ceiling grid systems typically comprise a plurality of main runners along with a plurality of cross runners oriented perpendicular or transverse to the main runners. This arrangement of main runners and cross runners forms a two-dimensional grid or array that is horizontally disposed in a ceiling of a room. The main runners and cross runners are usually attached by, e.g., hanger clips, brackets, wires, etc. to the overhead ceiling members or substructure (e.g., ceiling/floor joists for the surface above in the room of the home or building) and extend vertically downward therefrom a predetermined distance. This "clearance" distance is kept as small as possible in order to maximize the vertical distance in the room between the floor of the room and the bottom of the suspended ceiling (i.e., the ceiling height or occupied space in the room).

Also, the main runners and cross runners are spaced apart such that they define rectilinear (e.g., square or rectangular) openings with uniform dimensions such as, for example, two feet by two feet, two feet by four feet, or other known standard dimensions. Ceiling panels are then placed within the openings. These main runners and cross runners are commonly made from a rigid material such as extruded aluminum, plastic or lighter gauge steel and typically have flanged surfaces which are disposed or extend horizontally at the edges of the defined openings. The flanged surfaces are generally fixed, and thus non-movable, and are configured to support and hold the outer edges of the individual ceiling panels or tiles in place such that the four outer peripheral edges of each ceiling panel rest on the corresponding upper surfaces of the flanges. Thus, a cross-sectional profile of a main runner or cross runner is generally in the shape of an upside down "T".

A primary problem with known ceiling grid systems is that because the flanged surfaces of the main runners and the cross runners are generally fixed and non-movable once the grid system has been installed, it becomes difficult for someone (especially a first time "do-it-yourself" person) to install or remove a ceiling panel at an opening in the grid system without damaging the ceiling panel. Specifically, because the outer peripheral edges of a ceiling panel typically rest on top of the upper surfaces of the flanges, the size of the opening defined by the main runners and the cross runners is somewhat smaller than the overall size of the ceiling panel. Also, physical objects such as light fixtures, air vents and ducts, sound speakers, electrical wiring, plumbing pipes, etc. are typically located within the plenum space at the upper portion of the room. It is generally desirable to conceal these physical objects in the plenum space using the suspended ceiling, while also allowing easy access to these objects when needed for, e.g., service or replacement. Thus, the location of these physical objects must be accounted for when initially installing the suspended ceiling in the room.

More importantly, oftentimes the person installing or removing the ceiling panels at the openings in the grid system is required to maneuver or angle the ceiling panel awkwardly to be able to position the panel within the opening so that the panel rests on the flanges, or to also remove the panel from the opening. This must be accomplished without allowing the ceiling panel to contact any of the aforementioned physical objects, all the while being done within the limited clearance distance in the plenum space between the upper ceiling/floor joists and the flanges of the runners. Further, because the ceiling panels are typically made from a lightweight and fragile material such as fiberboard, a portion of the panel material can easily break off or the surface of the ceiling panel facing the interior of the room can get scratched or marred during this installation or removal process, thereby damaging or ruining the ceiling panel and necessitating its replacement.

Therefore, what is needed is a ceiling grid system having a structure that allows for the relatively quick and easy installation and removal of the ceiling panels without damaging the panels.

BRIEF SUMMARY OF THE INVENTION

An object of embodiments of the present invention is to provide a ceiling grid system for a suspended ceiling in which the ceiling grid system requires less additional empty or free space in the plenum space above the ceiling grid system and below the upper structural elements such as ceiling or floor joists as compared to prior art ceiling grid systems.

Another object of embodiments of the present invention is to provide a ceiling grid system for a suspended ceiling which enables the placement of the overall suspended ceiling directly below structural elements such as ceiling or floor joists.

Yet another object of embodiments of the present invention is to provide a ceiling grid system for a suspended ceiling which effectively increases the vertical distance or occupied space in the room between the floor in the room and the bottom of the suspended ceiling.

Still another object of embodiments of the present invention is to provide a ceiling grid system for a suspended ceiling which allows for the relatively quick and easy installation and removal of the ceiling panels without damaging the panels.

Another object of embodiments of the present invention is to provide a ceiling grid system for a suspended ceiling which has flanges on four sides of an opening in the grid system to support the ceiling panels wherein the support flanges on a number of sides of an opening can be rotated to be moved out of their ceiling panel support positions to allow an individual ceiling panel to be installed or removed entirely from below the suspended ceiling.

According to an embodiment of the present invention, a ceiling grid system for use as part of a suspended ceiling having a plurality of ceiling panels is configured to hold each one of the ceiling panels in a predetermined position within the suspended ceiling when the suspended ceiling is installed in a physical space such as a room. The ceiling grid system includes a plurality of main runners configured to attach to a support structure in the physical space, and a plurality of cross-runners oriented transverse to the plurality of main runners thereby forming a two-dimensional array having a plurality of openings and being disposed in a horizontal plane in the physical space. Each one of the openings defines one of the predetermined positions within the suspended ceiling in which a corresponding ceiling panel is disposed. The main runners and the cross-runners are configured to attach to each other and to be fixed in the horizontal plane in the physical space. At least one of the main runners and at least one of the cross-runners including a flange configured to stiffen the main runner or the cross-runner to maintain the main runner and the cross-runner, respectively, in a straight-line position. The flange of the main runner is located at one of a top or a bottom of the main runner, and the flange when located at the bottom of the main runner is configured to support one of the ceiling panels. The flange of the cross-runner is located at one of a top or a bottom of the cross-runner, and the flange when located at the bottom of the cross-runner is configured to support one of the ceiling panels. At least one of the main runners and at least one of the cross-runners each having a plurality of slots located at periodically spaced intervals along a length of the main runner and the cross-runner, respectively. The ceiling grid system also includes a plurality of panel support members, each one of the panel support members connected with a predetermined one of the main runners or a predetermined one of the cross-runners, each one of the panel support members includes a flange configured to support one of the ceiling panels. At least one of the panel support members includes a plurality of tabs located at periodically spaced intervals along a length of the panel support member. Each one of the tabs is configured to interlock with a corresponding one of the slots in the main runner or cross-runner to form an interlocking tab and slot connection. Each one of the panel support members is movable in a rotatable manner with respect to the predetermined one of the main runners or the predetermined one of the cross-runners to facilitate a connection or a disconnection of the panel support member with the predetermined one of the main runners or cross-runners to thereby facilitate the installation or removal of one of the ceiling panels with respect to its predetermined position within the suspended ceiling.

According to another embodiment of the present invention, a ceiling grid system for use as part of a suspended ceiling includes a plurality of main runners configured to attach to a support structure in the physical space, and a plurality of cross-runners oriented transverse to the plurality of main runners thereby forming a two-dimensional array having a plurality of openings and being disposed in a horizontal plane in the physical space. Each one of the openings defines one of the predetermined positions within the suspended ceiling in which a corresponding ceiling panel is disposed. The main runners and the cross-runners are configured to attach to each other and to be fixed in the horizontal plane in the physical space. At least one of the main runners and at least one of the cross-runners including a flange configured to stiffen the main runner or the cross-runner to maintain the main runner and the cross-runner, respectively, in a straight-line position. The flange of the main runner is located at one of a top or a bottom of the main runner, and the flange when located at the bottom of the main runner is configured to support one of the ceiling panels. The flange of the cross-runner is located at one of a top or a bottom of the cross-runner, and the flange when located at the bottom of the cross-runner is configured to support one of the ceiling panels. Each one of the main runners and each one of the cross-runners include a plurality of connections of a first type. The ceiling grid system also includes a plurality of panel support members, each one of the panel support members includes a flange configured to support one of the ceiling panels and including a plurality of connections of a second type that is complementary to the plurality of connections of the first type. Each one of the panel support members is connected with a predetermined one of the main runners or a predetermined one of the cross-runners by engaging the connections of the second type with the corresponding connections of the first type to form a rotatable connection such that the panel support member is rotatable with respect to the main runner or to the cross-runner. Each one of the panel support members is configured to support one of the ceiling panels and is movable in a rotatable manner with respect to the predetermined one of the main runners or the predetermined one of the cross-runners to facilitate the installation or removal of the ceiling panel with respect to its predetermined position within the suspended ceiling.

According to yet another embodiment of the present invention, a runner is for use in a ceiling grid system that is part of a suspended ceiling. The runner includes a fixed portion configured to attach to a support structure in the physical space, a first support flange configured to stiffen the runner to maintain the runner in a straight-line, and a panel support portion configured to attach to the fixed portion. The fixed portion includes a first connection portion having at least two connections of a first type, which are spaced apart along a length of the first connection portion. The panel support portion includes a second support flange configured to support one of the ceiling panels and includes a second connection portion having at least two connections of a second type that is complementary to the connections of the first type. The connections of the second type are spaced apart along the second connection portion. The panel support portion engages the fixed portion by engaging each of the connections of the second type with a corresponding connection of the first type to form a rotatable connection that is configured to allow rotation of the panel support portion with respect to the fixed portion between at least two rotational positions of the panel support portion with respect to the fixed portion of the runner. A first one of the rotational positions is a panel support position to support the ceiling panel within the ceiling grid system. A second one of the rotational positions is a panel non-support position to facilitate removal of the ceiling panel from within the ceiling grid system.

BRIEF DESCRIPTION OF THE DRAWINGS

The subject matter, which is regarded as the disclosure herein of exemplary embodiments of the present invention, is particularly pointed out and distinctly claimed in the claims at the conclusion of this specification. The forgoing and other features and advantages of the present invention will become more apparent from the following detailed description taken in conjunction with the accompanying drawings in which:

DETAILED DESCRIPTION OF THE INVENTION

It should be understood that, throughout this patent application and specifically in the written description that follows and in the accompanying drawing figures, the terms "horizontal" and "vertical" refer to horizontal and vertical orientations, respectively, as would be viewed and understood by one of ordinary skill in the art, with reference to the typical horizontal placement or installation in a room of an overall suspended ceiling and the resulting horizontal and vertical orientations of its constituent components, such as a ceiling grid system and its associated components of embodiments of the present invention.

Figure 1:
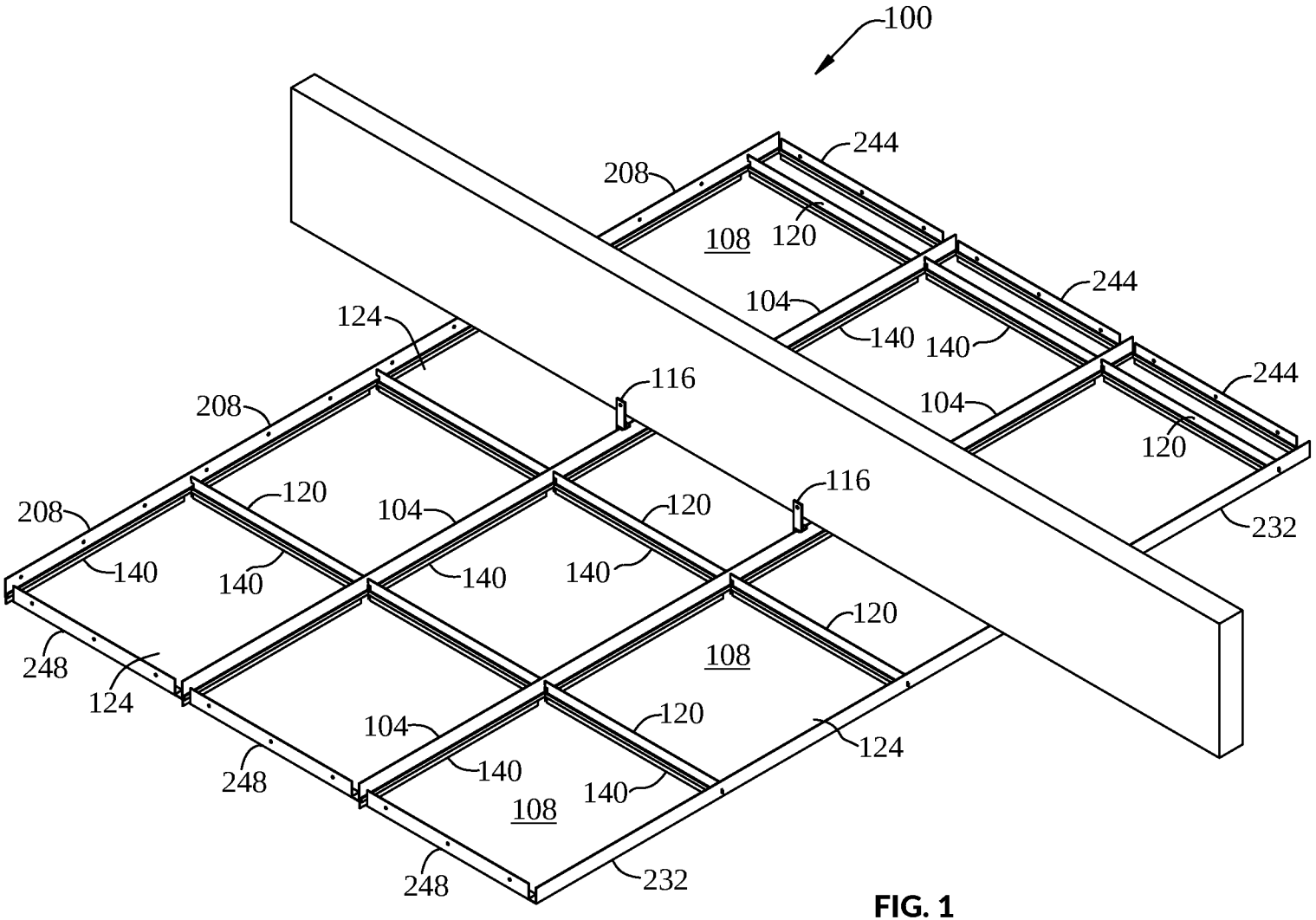
FIG. 1 is an isometric view of a ceiling grid system according to an embodiment of the present invention that is part of an overall suspended ceiling installed in a room.

Referring to FIG. 1, there illustrated is an isometric view of a ceiling grid system 100 according to an embodiment of the present invention. The ceiling grid system 100 is part of an overall suspended or drop ceiling that is commonly installed in a horizontal planar orientation in a room of a home or business such as in a commercial office space. These suspended ceilings are popular as they are an inexpensive and relatively quick and easy way for anyone (e.g., a "do-it-yourself" person) to add an aesthetically pleasing ceiling to a room such as in a basement of a home.

The ceiling grid system 100 includes a plurality of linear interior main runners 104 that are typically installed in a horizontal plane within the room, and parallel to each other at a spacing of the size of the square or rectangular ceiling panel 108 that is selected (e.g., two feet by two feet). In the embodiment shown in FIG. 1, two interior main runners 104 are illustrated; however, any number of interior main runners 104 may be utilized as necessary given the size of the room having the suspended ceiling installed and the teachings herein. The interior main runners 104 may be fastened in place to the structural members above (e.g., ceiling or floor joists 112) in a known manner by hanger clips, brackets, or wires 116.

Located between the interior main runners 104 are a plurality of linear interior cross-runners 120. The interior cross-runners 120 are disposed perpendicular or transverse to the interior main runners 104 and at a spacing of the size of the ceiling panel 108 selected (e.g., two feet by two feet). As such, and as seen in FIG. 1, the interior main runners 104 and the interior cross-runners 120 define the size and location of each one of a plurality of square-shaped or rectangular-shaped openings 124 within which a corresponding ceiling panel 108 is placed. Also, the interior main runners 104 and the interior cross-runners 120, together with various edge members described and illustrated in greater detail hereinafter, form a two-dimensional array or grid that defines the overall rectilinear shape and placement of the suspended ceiling within the room. In a typical suspended or drop ceiling, the interior main runners 104 are designed to carry most of the weight of the overall suspended ceiling, as compared to the interior cross-runners 120. In addition, each of the interior cross-runners 120 may be attached at each one of its two ends to the corresponding interior main runners 104 in a known manner, for example, by shaped tabs or protrusions inserted in correspondingly shaped pre-punched holes (e.g., T-shaped tabs and holes, vertical or horizontal tabs and holes, etc.) in the interior main runners 104, as described and illustrated in greater detail hereinafter. The specific type, shape or style of tab or protrusion and corresponding hole or receptacle is not a part of the broadest scope of embodiments of the present invention. Instead, any type of connection mechanism between the runners 104, 120 may be utilized in light of the teachings herein.

Figure 2:
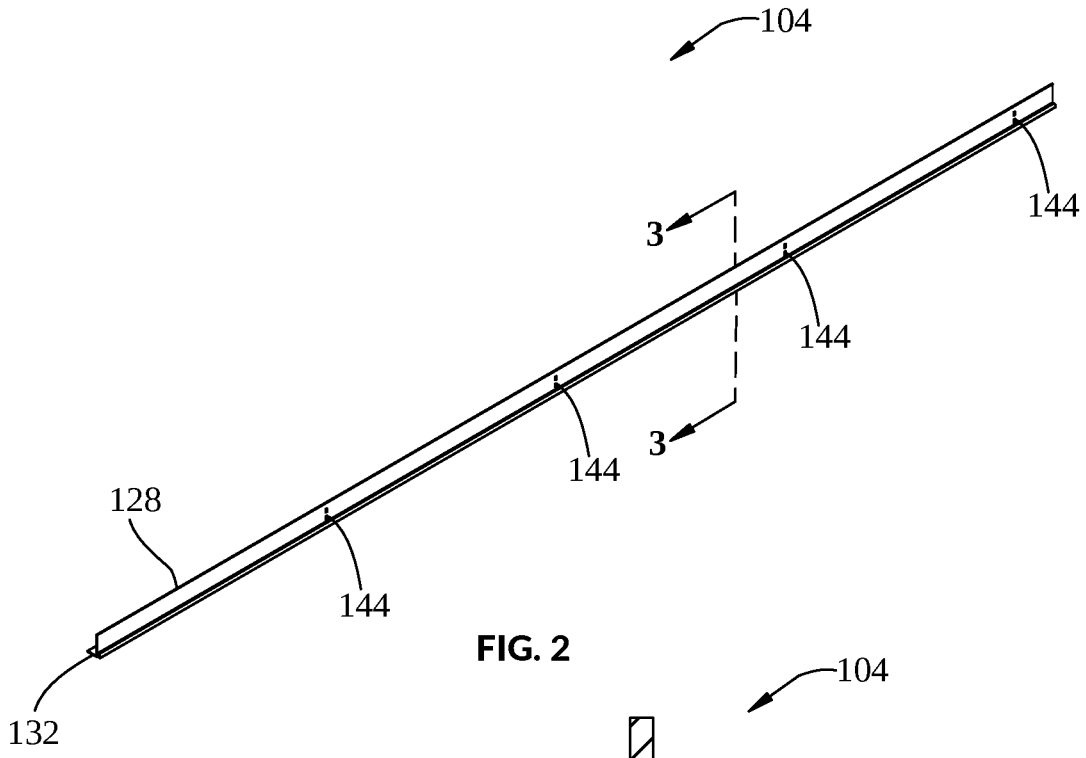
FIG. 2 is an isometric view of an interior main runner according to the embodiment of the present invention of FIG. 1.
Figure 3:
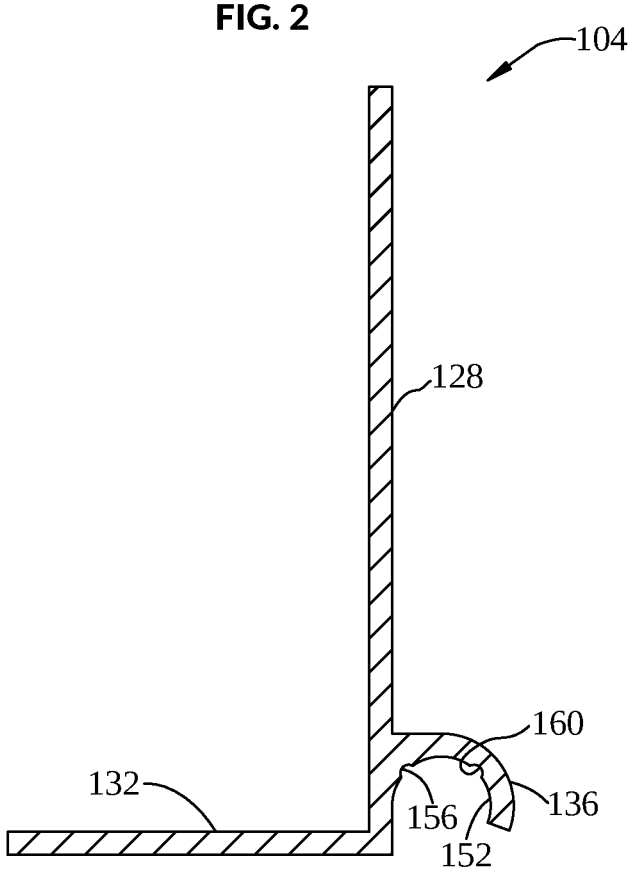
FIG. 3 is a cross-sectional view of the interior main runner of FIG. 2 taken along the lines 3-3 in FIG. 2.

Referring to FIGS. 2 and 3, according to an embodiment of the present invention, each of the interior main runners 104 has a cross-sectional profile that differs from the known upside down or inverted T-shaped profile of runners in the prior art. Specifically, the cross-sectional profile of each of the interior main runners 104 includes: (a) a vertical leg 128 that attaches to the ceiling or floor joists 112 using hanger clips, brackets, or wires 116 (as best seen in FIG. 1); (b) a fixed horizontal leg or flange 132 that supports one of the ceiling panels 108; and (c) a partially or less than fully circular (e.g., semicircular) or rounded shaped portion 136 that receives a separate rotatable panel support member 140 described and illustrated in greater detail hereinafter, with the panel support member 140 supporting another one of the ceiling panels 108 other than the ceiling panel 108 supported by the corresponding flange 132 of that same interior main runner 104. The fixed horizontal flange 132 of the interior main runner 104 may be referred to as the "fixed" side of the interior main runner 104, while the opposite side of the interior main runner 104 having the semicircular shaped portion 136 may be referred to as the "operable" side of the interior main runner 104.

The interior main runner 104 illustrated in FIG. 2 also includes a plurality of, e.g., T-shaped, pre-punched holes or slots 144 spaced apart at predetermined intervals and operable to receive the hook tabs 148 that are located at the ends of the interior cross-runners 120, as described hereinafter. However, it should be understood by one of ordinary skill in the art in light of the teachings herein that the various embodiments of the present invention described and illustrated herein are not limited to the tabs 148 being located on the interior cross-runners 120 and the holes 144 being located on the interior main runners 104. Instead, all or some of the tabs 148 may be located on the interior main runners 104 and all or some of the holes 144 may be located on the interior cross-runners 120 in various exemplary configurations.

As can be seen in FIG. 3, in an embodiment of the present invention, an inner surface 152 of the semicircular shaped portion 136 of the interior main runner 104 has two spaced apart depressions or grooves 156, 160 formed therein and disposed along the entire length of the interior main runner 104. These depressions or grooves 156, 160 may be circular or rounded or some other shape. As described and illustrated in greater detail hereinafter, the depressions or grooves 156, 160 create locking positions for the panel support member 140 in the horizontal and vertical positions.

Figure 4:
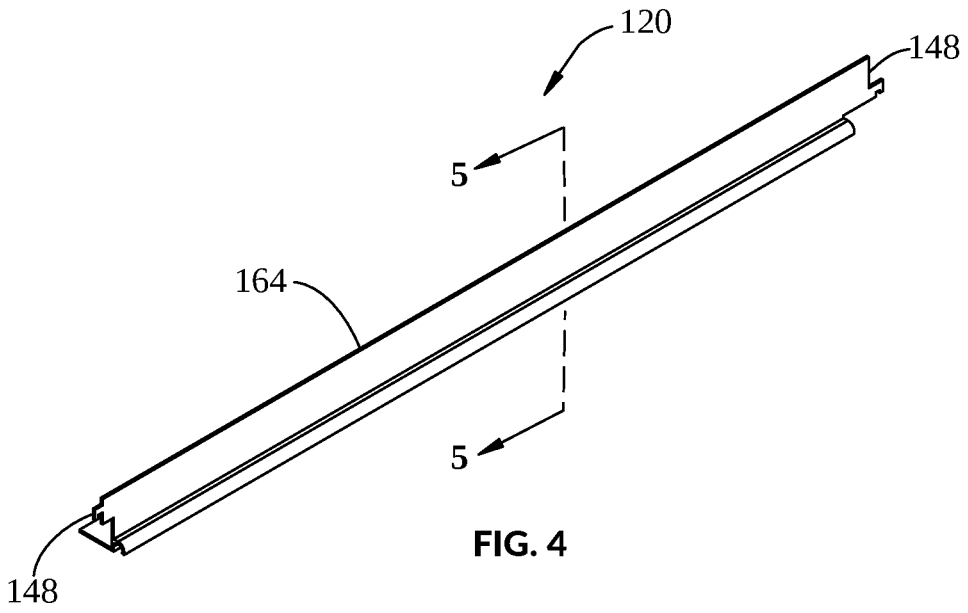
FIG. 4 is an isometric view of an interior cross-runner according to the embodiment of the present invention of FIG. 1.
Figure 5:
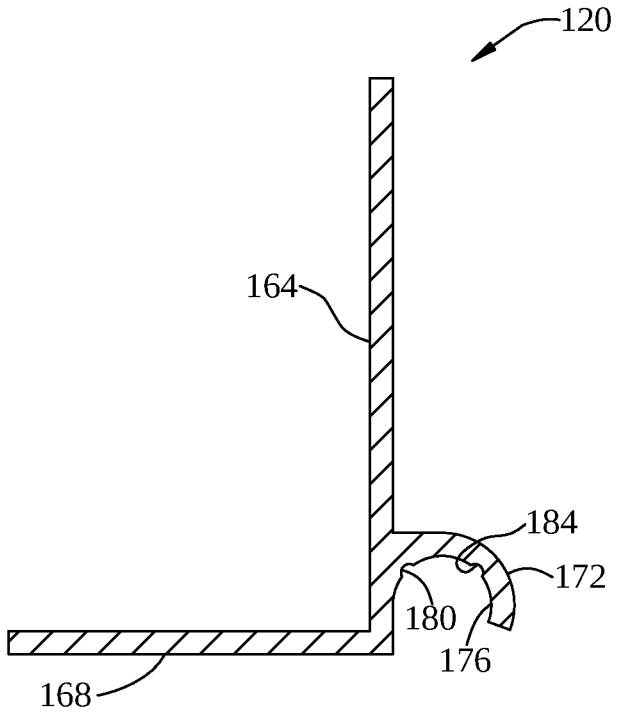
FIG. 5 is a cross-sectional view of the interior cross-runner of FIG. 4 taken along the lines 5-5 in FIG. 4.

Referring to FIGS. 4 and 5, according to an embodiment of the present invention, each of the interior cross-runners 120 has a cross-sectional profile that is similar to that of the interior main runner 104, as described hereinabove and illustrated in FIGS. 2 and 3. Specifically, the cross-sectional profile of each of the interior cross-runners 120 includes: (a) a vertical leg 164; (b) a fixed horizontal leg or flange 168 that supports one of the ceiling panels 108; and (c) a partially or less than fully circular (e.g., semicircular) or rounded shaped portion 172 that receives the separate rotatable panel support member 140 described and illustrated in greater detail hereinafter, and which supports another one of the ceiling panels 108 other than the ceiling panel 108 supported by the corresponding flange 168 of that same interior cross-runner 120. The fixed horizontal leg or flange 168 of the interior cross-runner 120 may be referred to as the "fixed" side of the interior cross-runner 120, while the opposite side of the interior cross-runner 120 having the semicircular shaped portion 172 may be referred to as the "operable" side of the interior cross-runner 120. The interior cross-runner 120 illustrated in FIG. 4 also includes the hook tab 148 at each end that is inserted into the corresponding one of the T-shaped pre-punched holes 144 within the interior main runner 104.

Similar to the interior main runner 104 illustrated in FIGS. 2 and 3, in an embodiment of the present invention, an inner surface 176 of the semicircular shaped portion 172 of the interior cross-runner 120 has two spaced apart depressions or grooves 180, 184 formed therein and disposed along the entire length of the interior cross-runner 120. These depressions or grooves 180, 184 may be circular or rounded or some other shape. As described and illustrated in greater detail hereinafter, the depressions or grooves 180, 184 create locking positions for the panel support member 140 in the horizontal and vertical positions.

As seen in FIG. 1, the placement of the interior cross-runners 120 between the interior main runners 104 results in the fixed horizontal leg or flange 168 of the interior cross-runner 120 and the fixed horizontal leg or flange 132 of the interior main runner 104 being adjacent and at a right angle to each other. Also, the placement of the interior cross-runners 120 between the interior main runners 104 results in the semicircular shaped portion 172 of the interior cross-runner 120 and the semicircular shaped portion 136 of the interior main runner 104 being adjacent and at a right angle to each other. The significance of these relationships is described and illustrated in greater detail hereinafter. Also, the configuration of the tabs 148 on the interior cross-runners 120 paired with the holes 144 in the interior main runners 104 allows for the assembly of the ceiling grid system 100 in the correct orientation.

Figure 6:
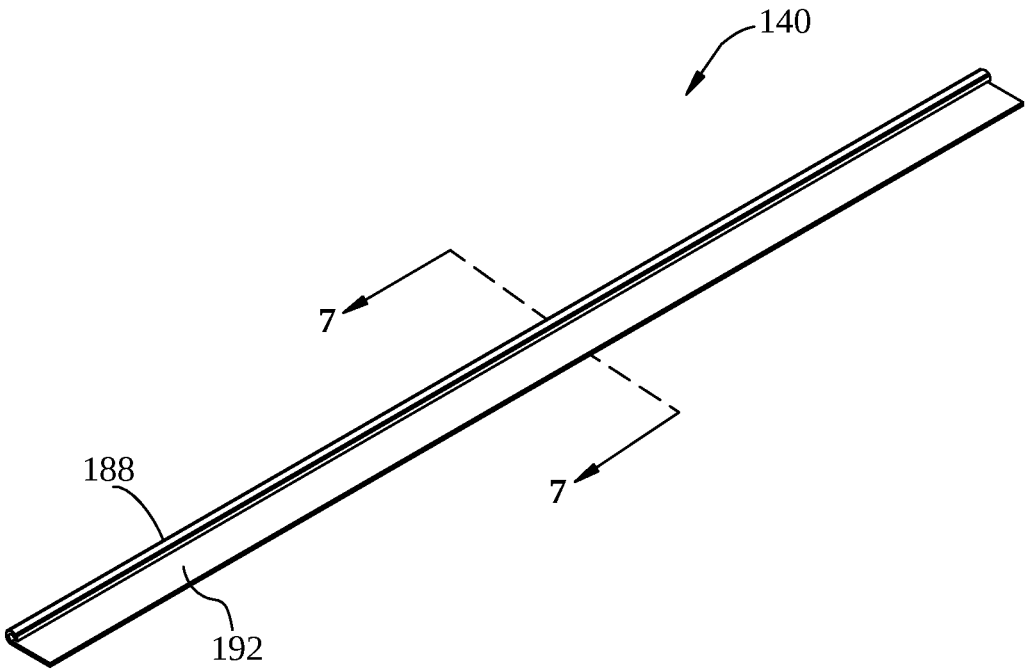
FIG. 6 is an isometric view of a panel support member according to the embodiment of the present invention of FIG. 1.
Figure 7:
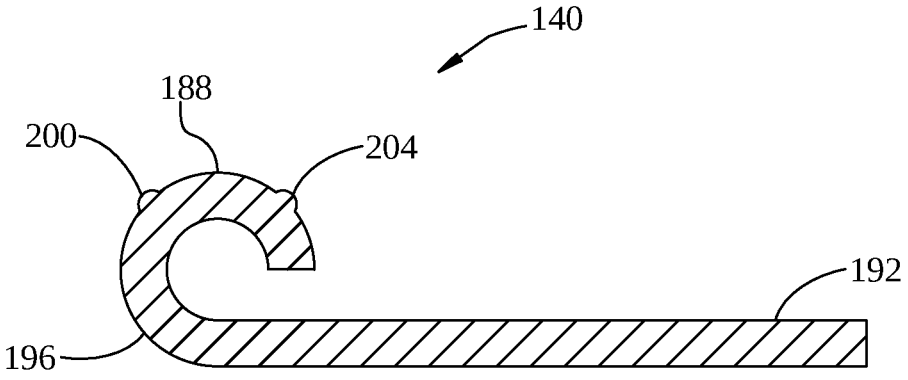
FIG. 7 is a cross-sectional view of the panel support member of FIG. 6 taken along the lines 7-7 in FIG. 6.

Referring to FIGS. 6 and 7, there illustrated is an exemplary embodiment of a panel support member 140. The panel support member 140 may have a length that equals a portion of the length of the interior main runner 104 and a portion of the length of the interior cross-runner 120. The length of a particular panel support member 140 depends in part on the size of the opening 124, which itself depends on the size of the ceiling panel 108 selected. The length of a particular panel support member 140 also depends in part on any physical size constraints imposed when the interior main runners 104 connect with the interior cross-runners 120 (e.g., in corners where these runners 104, 120 are connected). As seen in FIG. 7, the panel support member 140 has a cross-sectional profile that includes a partially or fully circular (e.g., semicircular) or rounded shaped portion 188 at one end. The other end of the panel support member 140 has a horizontal flange 192 that is used to support a ceiling panel 108, as described and illustrated in greater detail hereinafter.

An outer surface 196 of the semicircular shaped portion 188 of the panel support member 140 has a pair of spaced apart raised protrusions or ridges 200, 204 formed therein and disposed along the entire length of the panel support member 140. The raised protrusions or ridges 200, 204 are sized, shaped and located to fit or nest snugly within the two depressions or grooves 156, 160 formed in the interior main runner 104 (FIG. 3), and the two depressions or grooves 180, 184 formed in the interior cross-runner 120 (FIG. 5). Also, the size of the diameter of the semicircular shaped portion 136, 172 of both the inner surface 152 of the interior main runner 104 and of the inner surface 176 of the interior cross-runner 120 may be slightly larger than that of the outer surface 196 of the semicircular shaped portion 188 of the panel support member 140. This facilitates the proper receiving and operation of the panel support member 140 therewithin.

Figure 10:
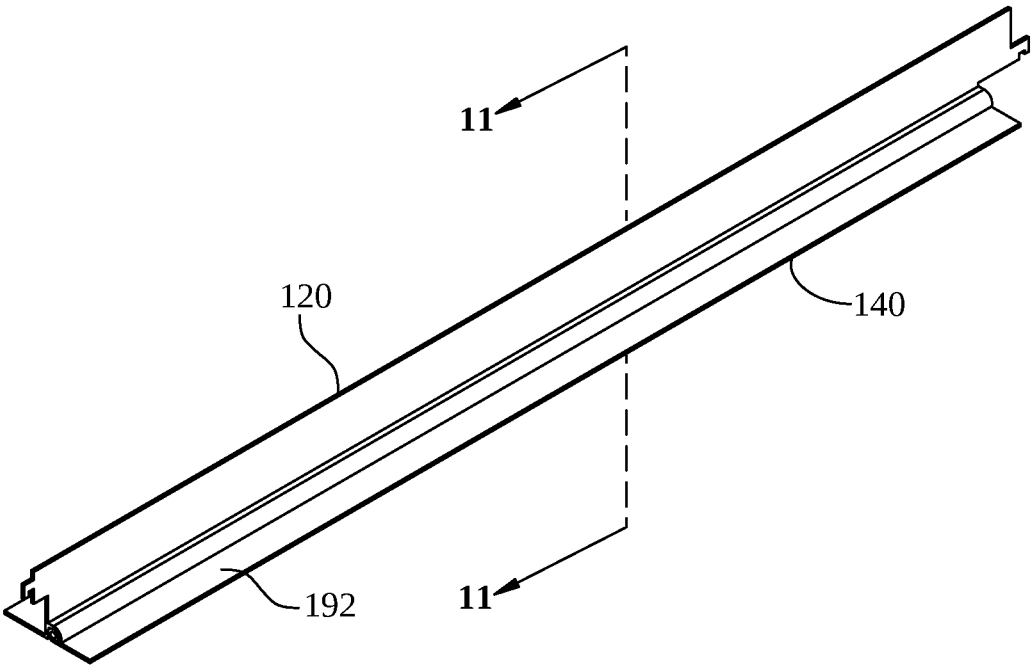
FIG. 10 is an isometric view of the interior cross-runner of FIG. 4 connected with the panel support member of FIG. 6 in a closed position.
Figure 11:
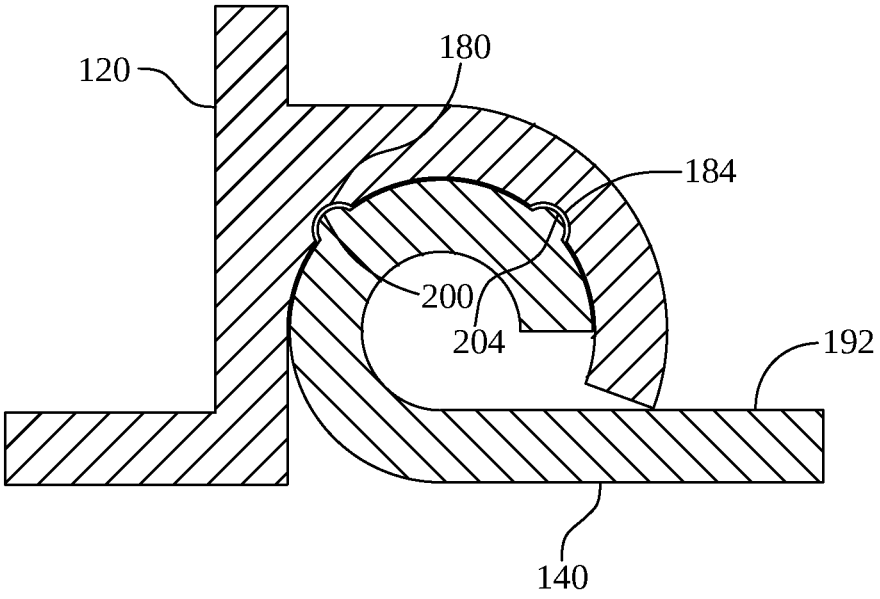
FIG. 11 is a cross-sectional view of the interior cross-runner of FIG. 4 connected with the panel support member of FIG. 6 in a closed position, as shown in FIG. 10 and taken along the lines 11-11 in FIG. 10.

When nested as described and illustrated in greater detail hereinafter, the interlocking grooves 156, 160, 180, 184 and ridges 200, 204 are operable to keep the panel support member 140 locked or fixed in one of two different positions with respect to either the interior main runner 104 or the interior cross-runner 120. Referring to FIGS. 10 and 11, a first position is a horizontal position in which the horizontal flange 192 of the panel support member 140 supports one of the ceiling panels 108 within one of the openings 124 in the ceiling grid system 100. Note that in this horizontal position, the horizontal flange 192 of the panel support member 140 is located in the same horizontal plane as that of both the fixed horizontal flange 132 of the interior main runner 104 and the fixed horizontal flange 168 of the interior cross-runner 120. This allows for the proper horizontal leveling of the ceiling panels 108 within the corresponding openings 124. Also, this proper horizontal positioning of the horizontal flange 192 of the panel support member 140 is achieved by the placement of the semicircular shaped portion 136 on the interior main runner 104 and of the placement of the semicircular shaped portion 172 on the interior cross-runner 120.

Figure 8:
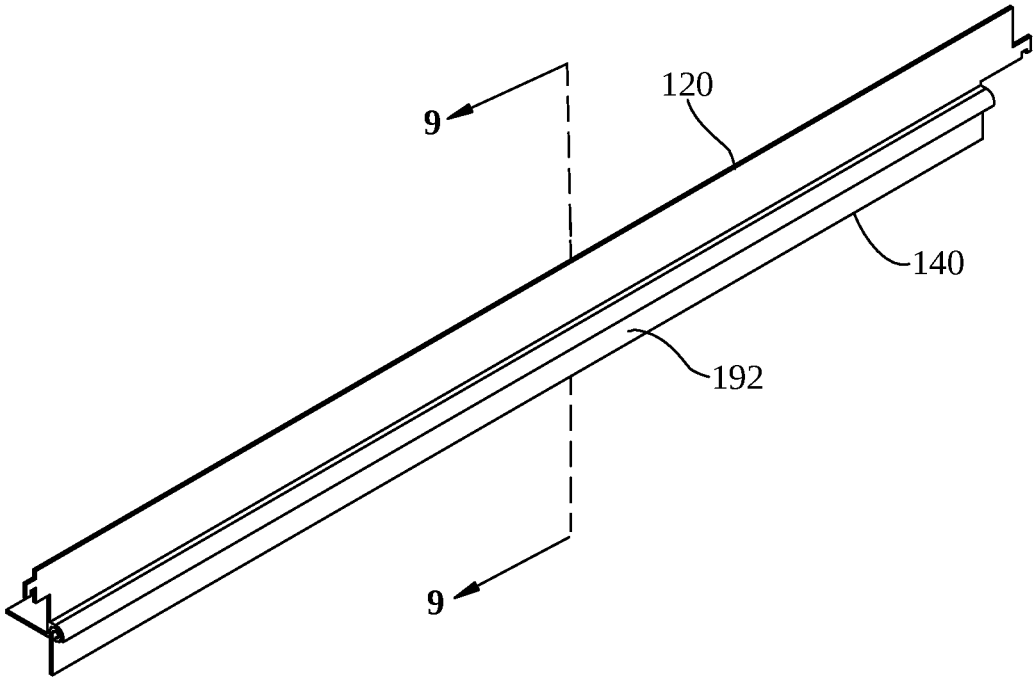
FIG. 8 is an isometric view of the interior cross-runner of FIG. 4 connected with the panel support member of FIG. 6 in an open position.
Figure 9:
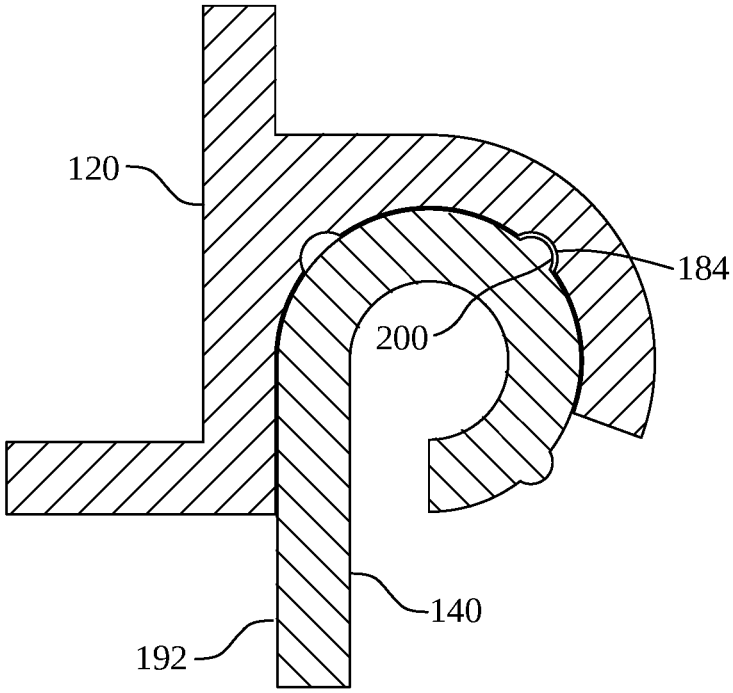
FIG. 9 is a cross-sectional view of the interior cross-runner of FIG. 4 connected with the panel support member of FIG. 6 in an open position, as shown in FIG. 8 and taken along the lines 9-9 in FIG. 8.

Referring to FIGS. 8 and 9, a second position is the horizontal flange 192 being in a downward vertical position such that the horizontal flange 192 does not support the ceiling panel 108. Instead, this downward vertical position allows for the relatively quick and easy installation or removal of the ceiling panel 108 from below the corresponding opening 124 in the ceiling grid system 100.

Thus, as can be seen from the foregoing, the ceiling grid system 100 of embodiments of the present invention allows for the installation or removal of the ceiling panel 108 from below the opening 124 in the ceiling grid system 100. This is in contrast to someone being required to install or remove the ceiling panel 108 from above the opening 124, as is well known in prior art ceiling grid systems and as discussed hereinbefore in the "BACKGROUND OF THE INVENTION" section. Therefore, the ceiling grid system 100 of embodiments of the present invention represents a number of technical advantages and also eliminates a number of the aforementioned problems with prior art ceiling grid systems.

Referring to FIGS. 8 and 9, there illustrated are an isometric view and a cross-sectional view of an interior cross-runner 120 connected with a panel support member 140 in an assembly and with the panel support member 140 in an open position (i.e., with the horizontal flange 192 in the downward vertical "ceiling panel non-support" position). Referring also to FIGS. 10 and 11, there illustrated are an isometric view and a cross-sectional view of the interior cross-runner 120 connected with the panel support member 140 and with the panel support member 140 in a closed position (i.e., with the horizontal flange 192 in the horizontal "ceiling panel support" position).

The panel support member 140 can be easily rotated between the open position of FIGS. 8 and 9 and the closed position of FIGS. 10 and 11. As shown in FIG. 9, when in the open position, only one protrusion or ridge 200 of the panel support member 140 nests within the corresponding depression or groove 184 of the interior cross-runner 120. In contrast, as shown in FIG. 11, when in the closed position, both protrusions or ridges 200, 204 of the panel support member 140 nest within the corresponding depressions or grooves 180, 184 of the interior cross-runner 120. Having both protrusions or ridges 200, 204 nest within the two depressions or grooves 180, 184 provides for sufficient interlocking of the interior cross-runner 120 with the panel support member 140 to thereby ensure the ability of the panel support member 140 to support the ceiling panel 108. It should also be understood that utilizing two depressions or grooves 180, 184 and two protrusions or ridges 200, 204 is purely exemplary. Instead, any number of depressions or grooves 180, 184 and protrusions or ridges 200, 204 may be utilized in light of the teachings herein.

It should be understood by one of ordinary skill in the art that this disclosure and illustration of the interaction and operation of a panel support member 140 with an interior cross-runner 120 is equally applicable to the interaction and operation of a panel support member 140 with an interior main runner 104. This is because, as described hereinabove and illustrated in FIGS. 2 and 3, the interior main runner 104 has a similar semicircular shaped portion 136 that is designed to interact with a panel support member 140 in the same manner as that of the interior cross-runner 120.

Referring to FIG. 1, the location of both the interior main runners 104 and the interior cross-runners 120 within the ceiling grid system 100 of embodiments of the present invention is such that, within any one of the openings 124 of the ceiling grid system 100, an operable side of an interior main runner 104 is adjacent to and at a right angle to an operable side of a interior cross-runner 120, and is also opposite to or across from a fixed side of another interior main runner 104 (or of an edge angle runner 232 described and illustrated in more detail hereinafter). It also follows that the operable side of the interior cross-runner 120 within that same opening 124 is opposite to or across from the fixed side of another interior cross-runner 120 (or of a cross-angle end runner 248 described and illustrated in more detail hereinafter). Thus, in the embodiment of the present invention of FIG. 1, two operable sides and two fixed sides are located within any one of the four-sided openings 124.

A result of this ceiling grid system 100 configuration of interior main runners 104 and interior cross-runners 120 is that in any one of the openings 124 within the ceiling grid system 100 of embodiments of the present invention, two adjacent operable sides of an interior man runner 104 and of an interior cross-runner 120 can be rotated to the downward vertical position. This allows someone to insert or install a ceiling panel 108 into the opening 124 from below the ceiling grid system 100. As such, the ceiling panel 108 rests on the two adjacent fixed horizontal flanges 132, 168 of the interior main runner 104 and of the interior cross-runner 120, respectively. Then the panel support members 140 can be rotated to the horizontal position to properly support the ceiling panel 108 on the two operable sides of the interior main runner 104 and of the interior cross-runner 120. This can be done without having to awkwardly angle or maneuver the ceiling panel 108 from within the plenum space above the opening 124 and possibly breaking a portion of or damaging the ceiling panel 108, as is possible with prior art ceiling grid systems discussed hereinabove.

Embodiments of the ceiling grid system 100 of the present invention described hereinabove and illustrated in FIGS. 1-11 disclose a rectilinear ceiling grid system 100 having a plurality of four-sided square or rectangular openings 124, with each opening 124 accommodating a ceiling panel 108. Further, each opening 124 has four sides, with two of the sides being operable and the other two sides being fixed. However, it should be understood that the broadest scope of the present invention is not limited as such. Instead, other embodiments of ceiling grid systems 100 that are contemplated by the present invention include those that have only one operable side and three fixed sides, or that have three or four operable sides and one or zero fixed sides, respectively. Also, in an embodiment with two operable sides and two fixed sides, the two operable sides do not necessarily need to be adjacent to each other. Instead, the two operable sides may be opposite each other such that the two fixed sides are opposite each other. It suffices for the broadest scope of the present invention that a ceiling grid system 100 has at least one operable side to allow for relatively quicker and easier access by someone to install or remove a ceiling panel from an opening on the ceiling grid system.

Further, embodiments of the ceiling grid system 100 of the present invention described hereinabove and illustrated in FIGS. 1-11 disclose a rectilinear ceiling grid system 100 having a plurality of interior main runners 104 and a plurality of interior cross-runners 120. However, as can be seen in FIG. 1, the interior main runners 104 and the interior cross-runners 120 are located within the interior portion of the ceiling grid system 100 and are typically not located at or along the peripheral edges or walls of a room in which the suspension ceiling is installed. Thus, the ceiling grid system 100 of embodiments of the present invention needs to account for these peripheral edges or walls of the room. This is accomplished by several additional members or components of the ceiling grid system 100 of embodiments of the present invention, as described and illustrated in greater detail hereinafter.

Figure 12:
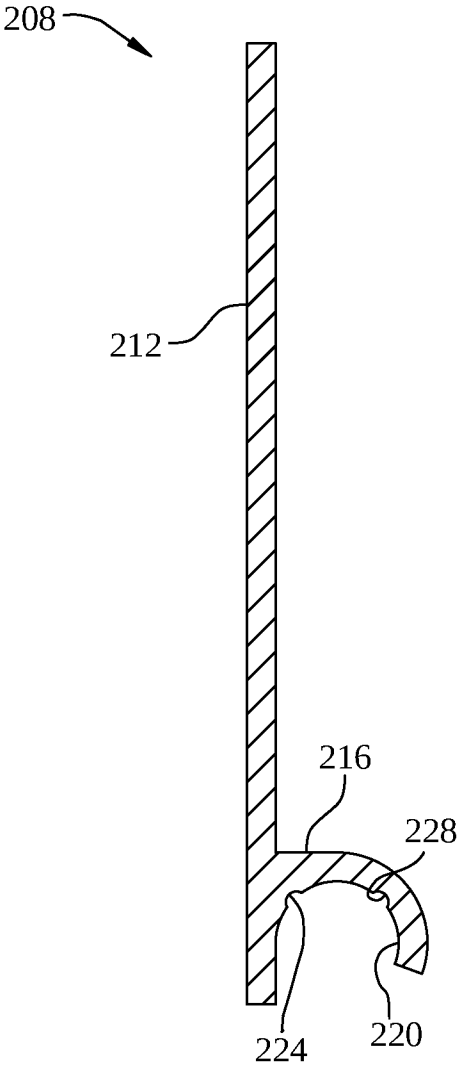
FIG. 12 is a cross-sectional view of an edge main runner according to the embodiment of the present invention of FIG. 1.

Referring to FIG. 12, there illustrated is a cross-sectional view of an edge main runner 208, which is similar to the interior main runner 104 except that the edge main runner 208 does not include the fixed horizontal flange 132. Specifically, the cross-sectional profile of the edge main runner 208 includes: (a) a vertical leg 212 that attaches to the wall or other surface in a room using, e.g., screws, nails, or other types of fasteners; and (b) a partially or less than fully circular (e.g., semicircular) or rounded shaped portion 216 that receives the separate rotatable panel support member 140. The semicircular shaped portion 216 is the operable side of the edge main runner 208 and interacts with a panel support member 140 to support a ceiling panel 108. Due to its positioning at the outer edges of a room (FIG. 1), the edge main runner 208 is intended to support only one ceiling panel 108 at its only one side—the operable side; hence there is no fixed horizontal flange 132 and thus no fixed side opposite the semicircular shaped portion 216 within the edge main runner 208, as compared to the interior main runner 104.

As can be seen in FIG. 12, and similar to the interior main runner 104, in an embodiment of the present invention, an inner surface 220 of the semicircular shaped portion 216 of the edge main runner 208 has two spaced apart depressions or grooves 224, 228 formed therein and disposed along the entire length of the edge main runner 208. These depressions or grooves 224, 228 may be circular or rounded or some other shape. The depressions or grooves 224, 228 create locking positions for the panel support member 140 in the horizontal and vertical positions, similar to the interior main runner 104.

Referring also to FIG. 1, the one or more edge main runners 208 are located within the ceiling grid system 100 in embodiments of the present invention at a position that is parallel to the interior main runners 104 and where there is a need to support a ceiling panel 108 with the operable side of the edge main runner 208. Further, the edge main runner 208 is installed so that the panel support member 140, when installed within the semicircular shaped portion 216 of the edge main runner 208, is in the same horizontal plane as the fixed horizontal flange 132 of the interior main runners 104 and the fixed horizontal flange 168 of the interior cross-runners 120.

Figure 13:
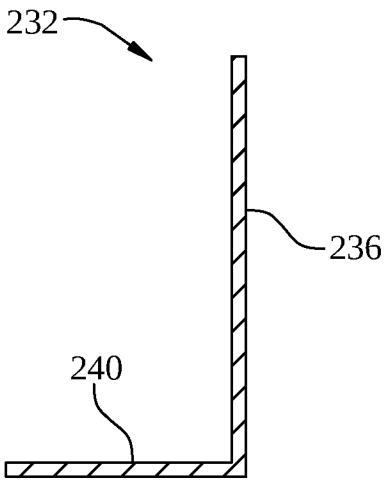
FIG. 13 is a cross-sectional view of an edge angle runner according to the embodiment of the present invention of FIG. 1.

Referring to FIG. 13, there illustrated is a cross-sectional view of an edge angle runner 232, which is similar to the interior main runner 104 except that the edge angle runner 232 does not include the semicircular shaped portion 136. Specifically, the cross-sectional profile of the edge main runner 232 includes: (a) a vertical leg 236 that attaches to the wall or other surface in a room using, e.g., screws, nails, or other types of fasteners; and (b) a fixed horizontal leg or flange 240 which is the fixed side of the edge angle runner 232 and supports a ceiling panel 108. Due to its positioning at the outer edges or walls of a room (FIG. 1), the edge angle runner 232 is intended to support only one ceiling panel 108 at its only one side—the fixed side; hence there is no semicircular shaped portion 136 and thus no operable side opposite the flange 240 within the edge angle runner 232, as compared to the interior main runner 104.

Referring also to FIG. 1, the one or more edge angle runners 232 are located within the ceiling grid system 100 in embodiments of the present invention at a position that is parallel the interior main runners 104 and where there is a need to support a ceiling panel 108 with the fixed side of the edge angle runner 208. The edge angle runner 232 is typically located on a wall that is parallel to and opposite a wall that the edge main runner 208 is mounted to. Further, the edge angle runner 232 is installed such that the fixed horizontal leg or flange 240 of the edge angle runner 232 is in the same horizontal plane as the fixed horizontal flange 132 of the interior main runners 104 and the fixed horizontal flange 168 of the interior cross-runners 120.

Similar to the edge main runner 208 and the edge angle runner 232 both being attached to opposite parallel walls in a room, a cross-end runner 244 and a cross-angle end runner 248 are provided (FIG. 1). The cross-end runner 244 has a cross-sectional profile similar to that of edge main runner 208, as shown in FIG. 12. Also, the cross-angle end runner 248 has a cross-sectional profile similar to that of edge angle runner 232, as shown in FIG. 13.

Referring to FIG. 1, the one or more cross-end runners 244 are located within the ceiling grid system 100 in embodiments of the present invention at a position that is parallel to the interior cross-runners 104 and where there is a need to support a ceiling panel 108 with the operable side of the cross-end runner 244. Further, the cross-end runner 244 is installed so that the panel support member 240, when installed within the semicircular shaped portion 216 of the cross-end runner 244, is in the same horizontal plane as the fixed horizontal flange 132 of the interior main runners 104 and the fixed horizontal flange 168 of the interior cross-runners 120.

Also, the one or more cross-angle end runners 248 are located within the ceiling grid system 100 in embodiments of the present invention at a position that is parallel to the interior cross-runners 120 and where there is a need to support a ceiling panel 108 with the fixed side of the cross-angle end runner 248. The cross-angle end runner 248 is typically located on a wall that is parallel to and opposite a wall that the cross-end runner 244 is mounted to. Further, the cross-angle end runner 248 is installed such that the fixed horizontal leg or flange 240 of the cross-angle end runner 232 is in the same horizontal plane as the fixed horizontal flange 132 of the interior main runners 104 and the fixed horizontal flange 168 of the interior cross-runners 120.

Embodiments of the ceiling grid system 100 of the present invention described hereinabove and illustrated in FIGS. 1-11 disclose an interior main runner 104 and an interior cross-runner 120 that each has a semicircular shaped portion 136, 172 which interfaces with a corresponding semicircular shaped portion 188 of a panel support member 140. As disclosed herein, these semicircular shaped portions 136, 172, 188 facilitate the rotation of the panel support member 140 with respect to the interior main runner 104 and the interior cross-runner 120 to thereby position the panel support member 140 to either support a ceiling panel 108 within an opening 108 of the ceiling grid system 100 or to facilitate its installation or removal therefrom.

Figure 14:
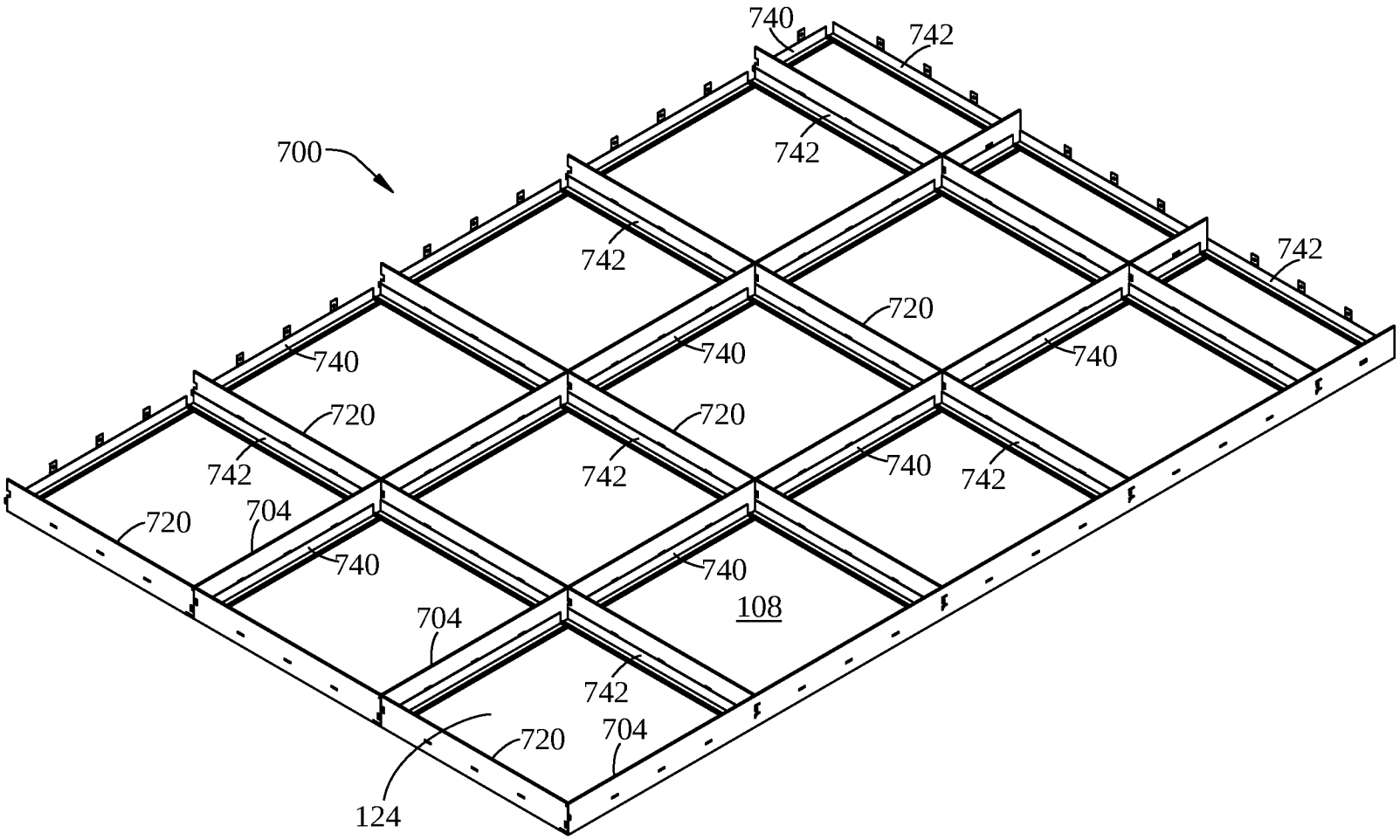
FIG. 14 is an isometric view of a ceiling grid system according to another embodiment of the present invention that is part of an overall suspended ceiling installed in a room.

Referring to FIG. 14, there illustrated is an isometric view of a ceiling grid system 700 according to another embodiment of the present invention. The ceiling grid system 700 includes a plurality of main runners 704, a plurality of cross-runners 720, a plurality of first panel support members 740, each of the first panel support members being configured to connect with one of the main runners 704, and a plurality of second panel support members 742, each of the second panel support members being configured to connect with one of the cross-runners 720.

In the embodiment shown in FIG. 14, one of the main runners 704 functions as an edge runner to border one of the long peripheral edges of the ceiling grid system 700. Multiple panel support members 740 are located along the other opposing, long peripheral edge of the ceiling grid system 700 in parallel to the main runner 704 next to the corresponding wall of the room. Also, one of the cross-runners 720 functions as an edge runner to border one of the short peripheral edges of the ceiling grid system 700. Multiple panel support members 742 are located along the other opposing, short peripheral edge of the ceiling grid system 700 in parallel to the cross-runner 720 next to the corresponding wall of the room. Each one of the panel support members 740 or 742 located on one of the peripheral edges borders a peripheral edge for one rectangular-shaped opening 124. For the openings 124 located at a corner of the ceiling grid system 700, the panel support members 740 and 742 may border two peripheral edges of the opening 124.

As best seen in FIGS. 19-22, each of the panel support members 740 or 742 comprises a plurality of S-shaped tabs 744 located on an upper edge of the panel support member. Each of the S-shaped tabs 744 has a central hole 752 located in the center of the tab 744. The holes 752 are configured to enable the S-shaped tabs 744 of a peripheral panel support member to be fixed to a wall of the room, therefore fixing the peripheral panel support member 740 to the wall of room. The S-shaped tabs 744 are operable to interlock with corresponding slots 716 (FIG. 15) in the main runner 704 or corresponding slots 736 (FIG. 17) in the cross-runner 720 to form a moveable connection in a rotatable manner of the panel support member 740 with respect to the main runner 704 or with respect to the cross-runner 720.

Figures 15, 16:
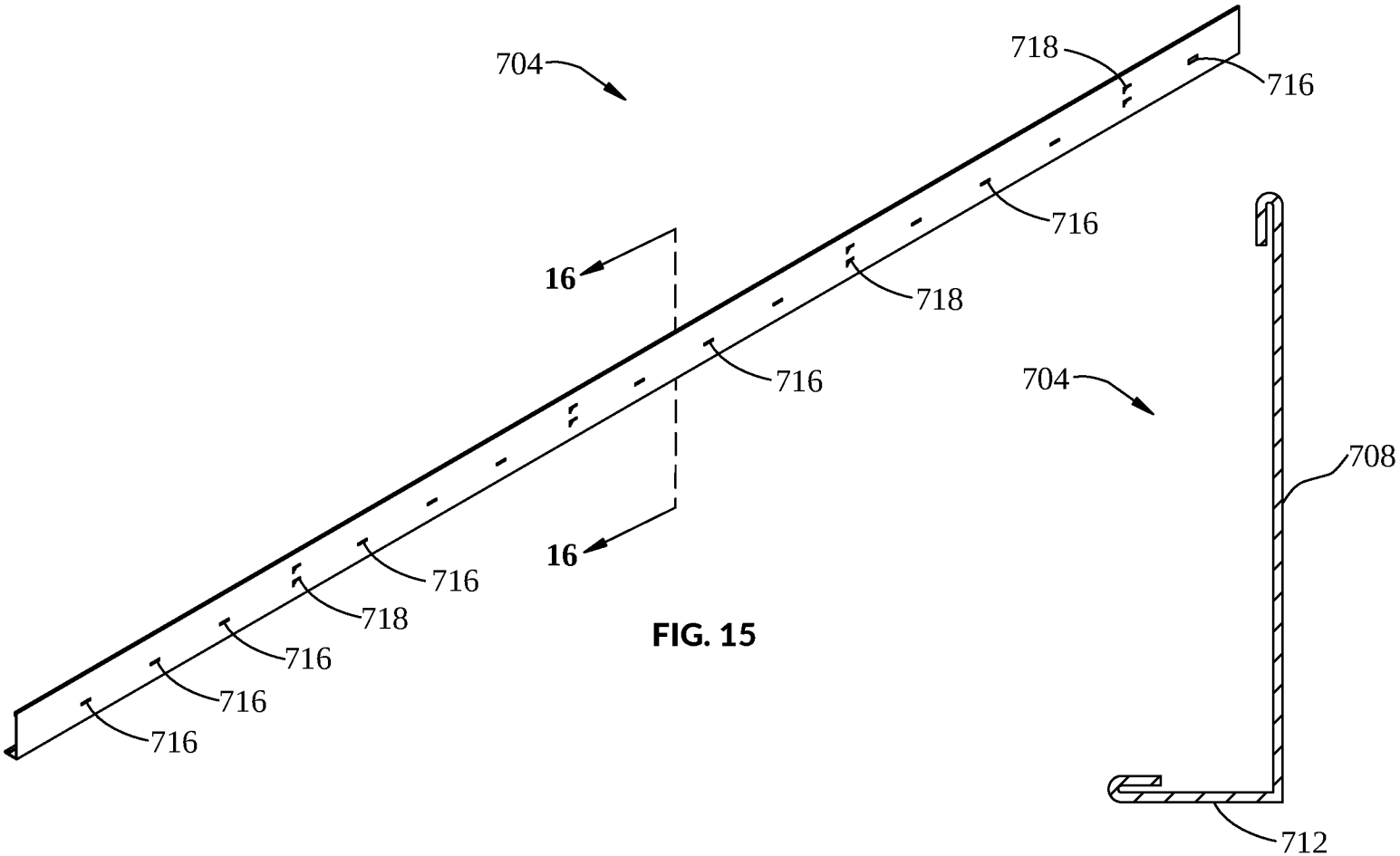
FIG. 15 is an isometric view of a main runner according to the embodiment of the present invention of FIG. 14.
FIG. 16 is a cross-sectional view of the main runner of FIG. 15 and taken along the lines 16-16 in FIG. 15.

Referring to FIGS. 15 and 16, there illustrated are an isometric view and a cross-sectional view, respectively, of a main runner 704 according to the embodiment of the present invention of FIG. 14. Each of the main runners 704 includes: (a) a vertical leg 708 that can be attached to the ceiling or floor joists using hanger clips, brackets, or wires; (b) a fixed horizontal flange 712 that supports one of the ceiling panels 108; and (c) a plurality of slots 716 formed therein at spaced apart intervals along a length of the main runner 704. As described and illustrated in greater detail hereinafter, the slots 716 are operable to engage with corresponding S-shaped tabs 744 that are part of a panel support member 740. As shown in FIGS. 15 and 16, the fixed horizontal flange 712 of the main runner 704 as configured is also operable to provide for stiffening of the main runner 704 to thereby maintain the main runner 704 in a straight-line position within the overall ceiling grid system 700.

The main runner 704 illustrated in FIG. 15 also includes a plurality of, e.g., T-shaped, pre-punched holes 718 spaced apart at predetermined intervals and operable to receive the hook tabs 728 (FIG. 17) that are located at ends of the interior cross-runners 720, as described hereinafter. However, it should be understood by one of ordinary skill in the art in light of the teachings herein that the various embodiments of the present invention described and illustrated herein are not limited to the hook tabs 728 being located on the cross-runners 720 and the holes 718 being located on the main runners 704. Instead, all or some of the hook tabs 728 may be located on the main runners 704 and all or some of the holes 718 may be located on the cross-runners 720 in various exemplary configurations.

Figure 17:
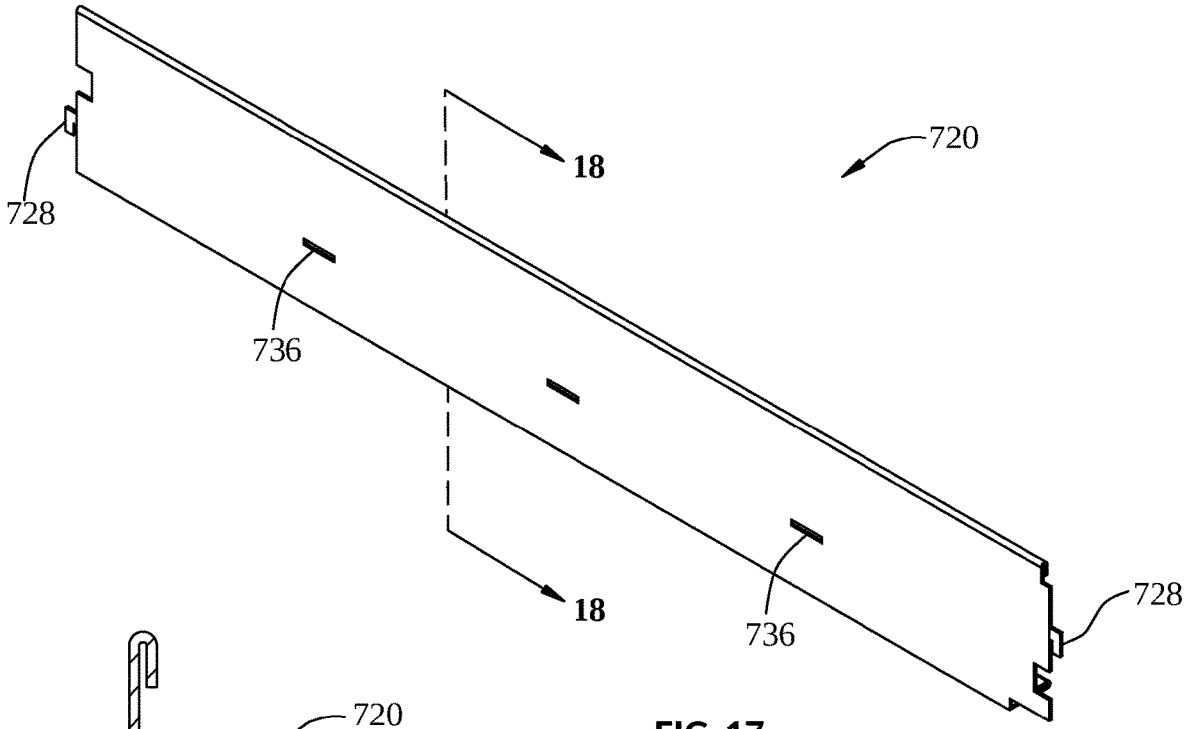
FIG. 17 is an isometric view of a cross-runner according to the embodiment of the present invention of FIG. 14.
Figure 18:
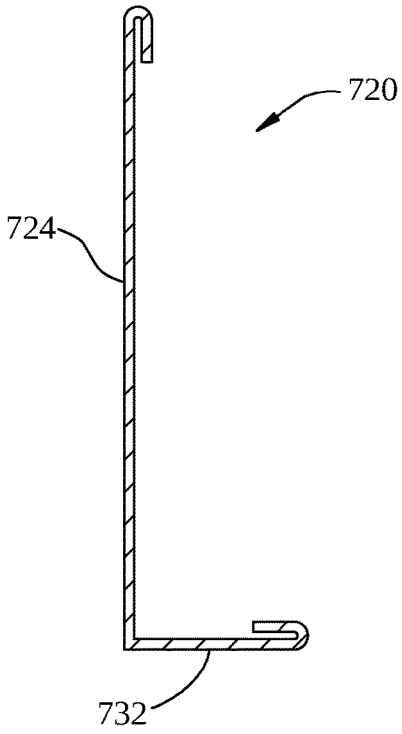
FIG. 18 is a cross-sectional view of the cross-runner of FIG. 17 and taken along the lines 18-18 in FIG. 17.

Referring to FIGS. 17 and 18, there illustrated are an isometric view and a cross-sectional view, respectively, of a cross-runner 720 according to the embodiment of the present invention of FIG. 14. The cross-runner 720 has a L-shaped cross-sectional profile that is similar to that of the main runner 704, as illustrated in FIG. 15. Each of the cross-runners 720 includes: (a) a vertical leg 724; (b) a fixed horizontal flange 732 that supports one of the ceiling panels 108; and (c) a plurality of slots 736 formed therein at spaced apart intervals along a length of the cross-runner 720. The cross-runner 720 illustrated in FIG. 17 further includes hook tabs 728 located at ends of the cross-runner 720, which are operable to interlock with the corresponding one of the T-shaped pre-punched holes 718 in the main runner 704. As shown in FIGS. 17 and 18, the fixed horizontal flange 732 of the cross-runner 720 as configured is also operable to provide for stiffening of the cross-runner 720 to thereby maintain the cross-runner 720 in a straight-line position within the overall ceiling grid system 700.

As seen in FIG. 14, the placement of the cross-runners 720 between the main runners 704 results in the fixed horizontal flange 732 of the cross-runner 720 and the fixed horizontal flange 712 of the main runner 704 being adjacent and at a right angle to each other. The configuration of the hook tabs 728 on the cross-runners 720 paired with the holes 718 in the interior main runners 704 allows for the assembly of the ceiling grid system 700 in the correct orientation.

Figure 19:
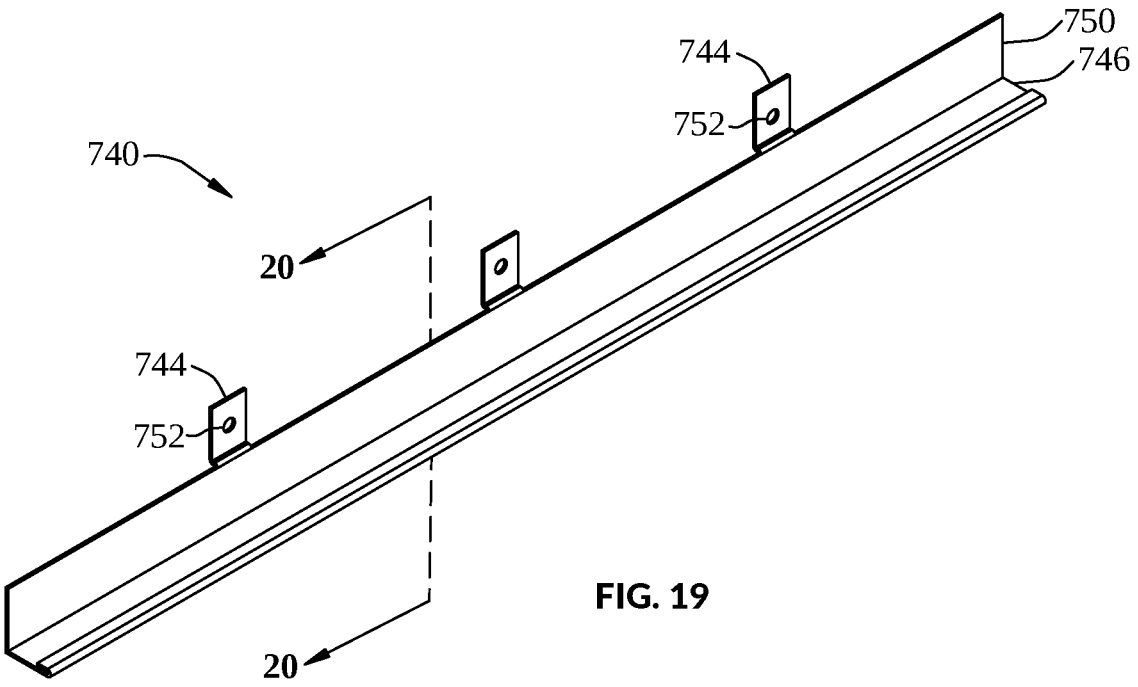
FIG. 19 is an isometric view of a first panel support member according to the embodiment of the present invention of FIG. 14.
Figure 20:
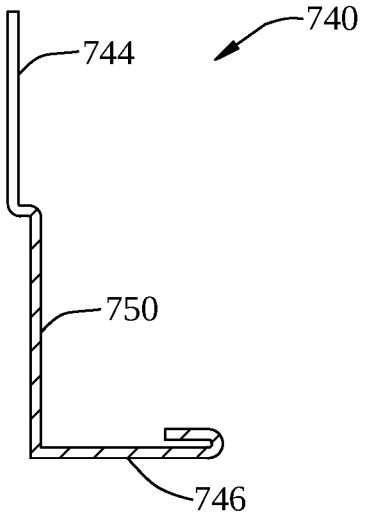
FIG. 20 is a cross-sectional view of the first panel support member of FIG. 19 and taken along the lines 20-20 in FIG. 19.

Referring to FIGS. 19 and 20, there illustrated are an isometric view and a cross-sectional view, respectively, of a first panel support member 740 configured to connect with a main runner 704 according to the embodiment of the present invention of FIG. 14. The first panel support member 740 includes a horizontal flange 746 and a vertical flange 750, both of which are formed therein along a length of the panel support member 740. The panel support member 740 further includes a plurality of S-shaped tabs 744 formed on a top edge or portion of the vertical flange 750 in spaced apart intervals along a length of the panel support member 740. The horizontal flange 746 is configured to support a ceiling panel 108. Each of the S-shaped tabs 744 has a small central hole 752. The holes 752 in the panel support member 740 are configured to enable the panel support members 740 located at a peripheral edge of the ceiling grid system 700 to be fixed to a wall of the room. The S-shaped tab 744 of the panel support member 740 is operable to engage with a corresponding one of the slots 716 in the main runner 704.

The S-shaped tabs 744 in the panel support members 740 and the corresponding slots 716 in the main runner 704 may be formed, for example, using one of the many variations of the known lance and form method, or by other known manufacturing methods. However, it should be understood that the ceiling grid system 700 of embodiments of the present invention are not limited to S-shaped tabs 744. Other shapes of a curve for the tab 744 may be utilized that are apparent to one of ordinary skill in the art in light of the teachings herein.

Figure 21:
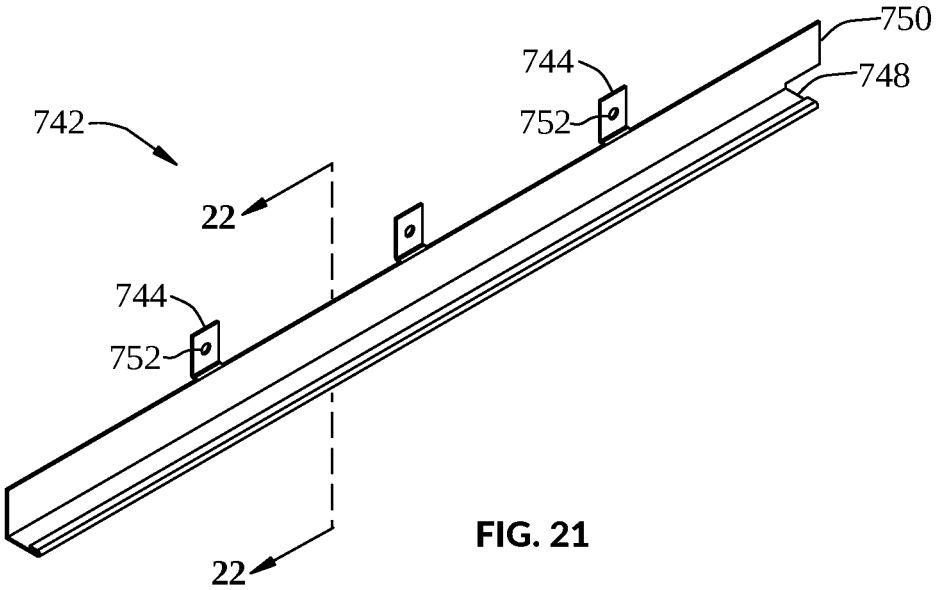
FIG. 21 is an isometric view of a second panel support member according to the embodiment of the present invention of FIG. 14.
Figure 22:
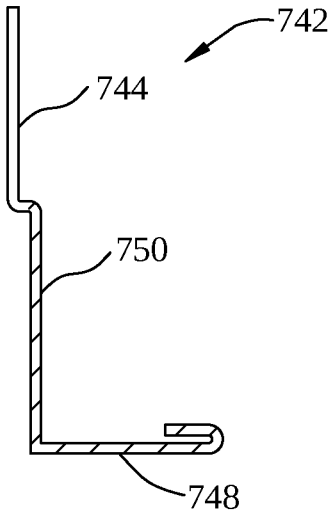
FIG. 22 is a cross-sectional view of the second panel support member of FIG. 21 and taken along the lines 22-22 in FIG. 21.

Referring to FIGS. 21 and 22, there illustrated are an isometric view and a cross-sectional view, respectively, of a second panel support member 742 configured to connect with a cross-runner 720 according to the embodiment of the present invention of FIG. 14. The second panel support member 742 of the cross-sectional view in FIG. 22 is essentially same as the first panel support member 740 of the cross-sectional view in FIG. 20. Similar to the first panel support member 740, the second panel support member 742 of the embodiment in FIG. 21 includes a horizontal flange 748 and a vertical flange 750, both of which are formed therein along a length of the panel support member 742. The second panel support member 742 further includes a plurality of S-shaped tabs 744 formed on a top edge or portion of the vertical flange 750 in spaced apart intervals along a length of the panel support member 742. Similar to the S-shaped tabs 744 in the first panel support member 740, each of the S-shaped tabs 744 of the second panel support member 742 has a central hole 752. The central holes 752 of the panel support member 742 are configured to enable a peripheral panel support member 742 to be fixed to a wall of the room. Each of the S-shaped tabs 744 is operable to engage with a corresponding one of the slots 736 in the cross-runner 720.

Referring to FIGS. 19 and 21, a primary difference between the two panel support members 740 and 742 is that the overall length of horizontal flange 748 of the second panel support member 742 configured to connect with the cross-runner 720 may be somewhat shorter than the length of the horizontal flange 746 of the first panel support member 740 configured to connect with the main runner 704. The shorter horizontal flange 748 of the second panel support member 742 leaves a sufficient amount of room to be occupied by the horizontal flange 746 of the first panel support member 740 when two adjacent flanges 746, 748 are positioned at a right angle with each other.

Referring to FIGS. 21 to 25, there illustrated is an exemplary embodiment of an assembling process of a ceiling panel 108 and a panel support member 742 to be mounted to a cross-runner 720 within an opening 124 in the ceiling grid system 700 according to the embodiment of the ceiling grid system 700 of FIG. 14. This ceiling panel assembling or mounting process as shown may be performed when another ceiling panel 108 is already positioned on the fixed horizontal flange 732 of the cross-runner 720 in an adjacent opening 124 in the ceiling grid system 700. However, the same ceiling panel assembling or mounting process may be performed whether or not another ceiling panel 108 is positioned on the fixed horizontal flange 732 of the cross-runner 720 in the adjacent opening 124.

Figure 23:
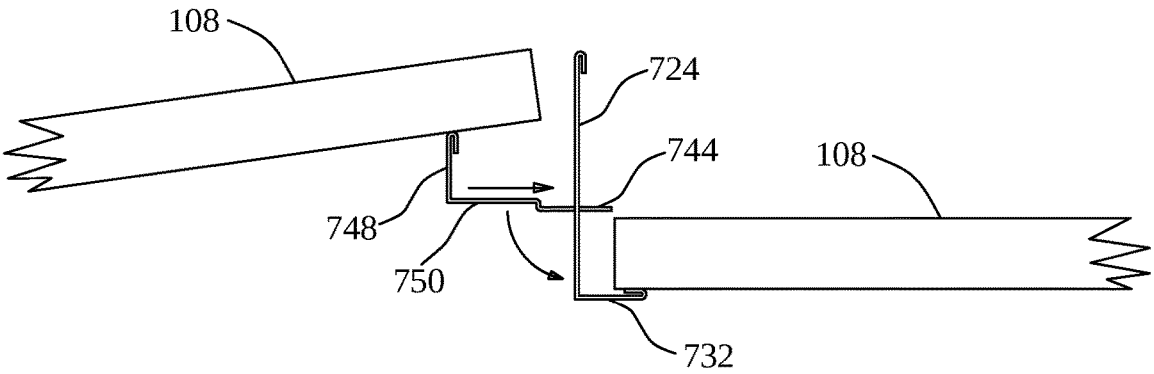
FIG. 23 is a sideview of a second panel support member to be inserted into the cross-runner and to be rotated into the supporting position for a second ceiling panel after installation of a first ceiling panel on the flange of the cross-runner according to the embodiment of the present invention of FIG. 14.

As shown in FIG. 23, the mounting of the ceiling panel 108 is performed by rotating the panel support member 742 so that its S-shaped tabs 744 are generally moving towards a horizontal position. The S-shaped tabs 744 are then inserted into the corresponding slots 736 in the cross runner 720 and a ceiling panel 108 is inserted to the opening 124 to be placed on top of an edge of the horizontal flange 748 of the panel support member 742.

Figure 24:
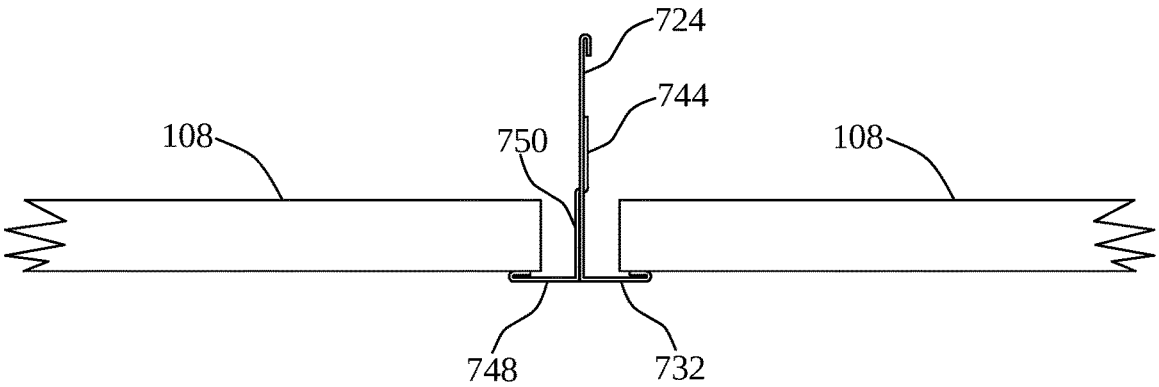
FIG. 24 is a sideview of the second ceiling panel mounted onto the flange of the panel support member according to the embodiment of the present invention of FIG. 14.

Referring to FIG. 24, there illustrated is the panel support member 742 rotated downward into a vertical position such that the tabs 744 interlock with the corresponding slots 736 of the cross-runner 720, and the ceiling panel 108 thus rests on the horizontal flange 748 of the panel support member 742. As such, the ceiling panel 108 is in its normal position within the overall suspended ceiling.

Figure 25:
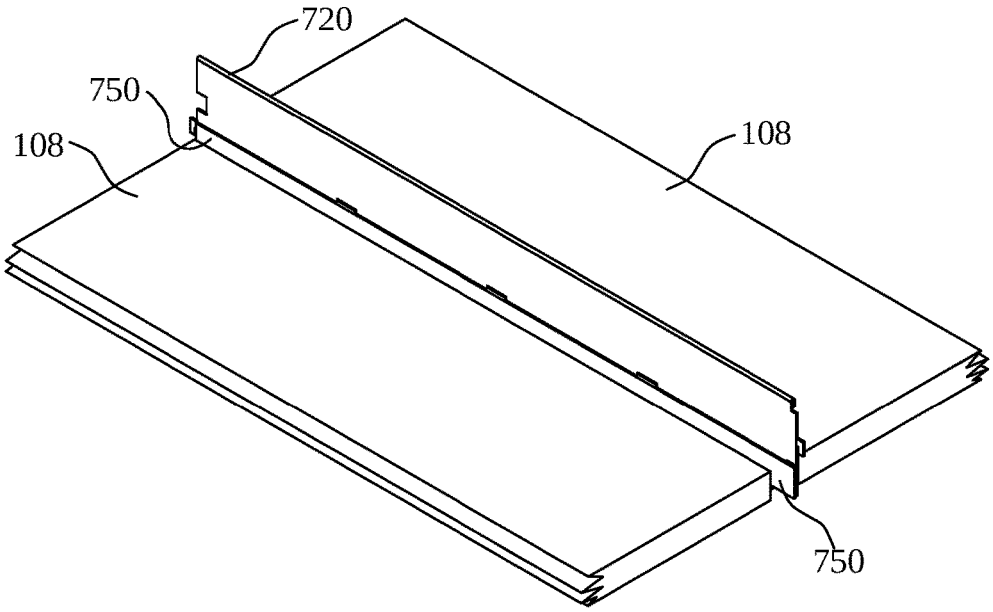
FIG. 25 is an isometric view of the two ceiling panels supported on the two flanges according to the embodiment of the present invention of FIG. 14.

Referring to FIG. 25, there illustrated is an isometric view of two ceiling panels 108 supported on the two flanges attached to the cross-runner 720. One of the flanges is a fixed horizontal flange 732 of the cross-runner 720 and the other horizontal flange is the horizontal flange 748 of the panel support member 742 interlocked to the cross-runner 720. Note that the same assembling process of the ceiling panel 108 and the panel support member 742 with the cross-runner 720 is applicable for the assembling of a ceiling panel 108 and a panel support member 740 with a main runner 704 in the ceiling grid system 700.

It is to be noted that the horizontal flange 748 of the panel support member 742 is located in the same horizontal plane as that of the fixed horizontal flange 732 of the cross-runner 720. This allows for the proper horizontal leveling of the ceiling panels 108 within the corresponding openings 124. Also, this proper horizontal positioning of the horizontal flange 748 of the panel support member 742 is achieved by the engagement of the slots 736 of the cross-runner 720 with the S-shaped tabs 744 of the panel support member 742.

To remove a panel support member 740 or 742 from an opening 124 in the ceiling grid system 700 of FIG. 14, all that is required is to rotate the panel support member 740 or 742 upwards so that the vertical flange 750 is rotated towards a horizontal position. This is followed by disengaging the S-shaped tabs 744 from the slots 716 in the main runner 704 or from the slots 736 in the cross-runner 720. It can be performed on any one of the panel support members 740 or 742 that are utilized within any one of the openings 124 of the ceiling grid system 700 of FIG. 14. Also, this movement of the panel support members 740 or 742 can be performed by someone from below the ceiling grid system 700 in accordance with embodiments of the present invention.

Advantageously, someone installing or removing a ceiling panel 108 with respect its corresponding opening 124 within the ceiling grid system 700 of exemplary embodiments of the present invention need only raise the ceiling panel 108 to no higher than the top level of the ceiling grid system 700. This overcomes many of the problems of the prior art described hereinabove in which it is required to raise the ceiling panel 108 relatively much higher than the top level of the ceiling grid system 700. This introduces the aforementioned problems of the having the ceiling panel 108 come in contact with items in the plenum or space above the ceiling grid system 700, or having the installer being forced to twist or bend the panel 108 into awkward positions, thereby greatly increasing the chances of breaking or damaging the panels 108.

Figure 26:
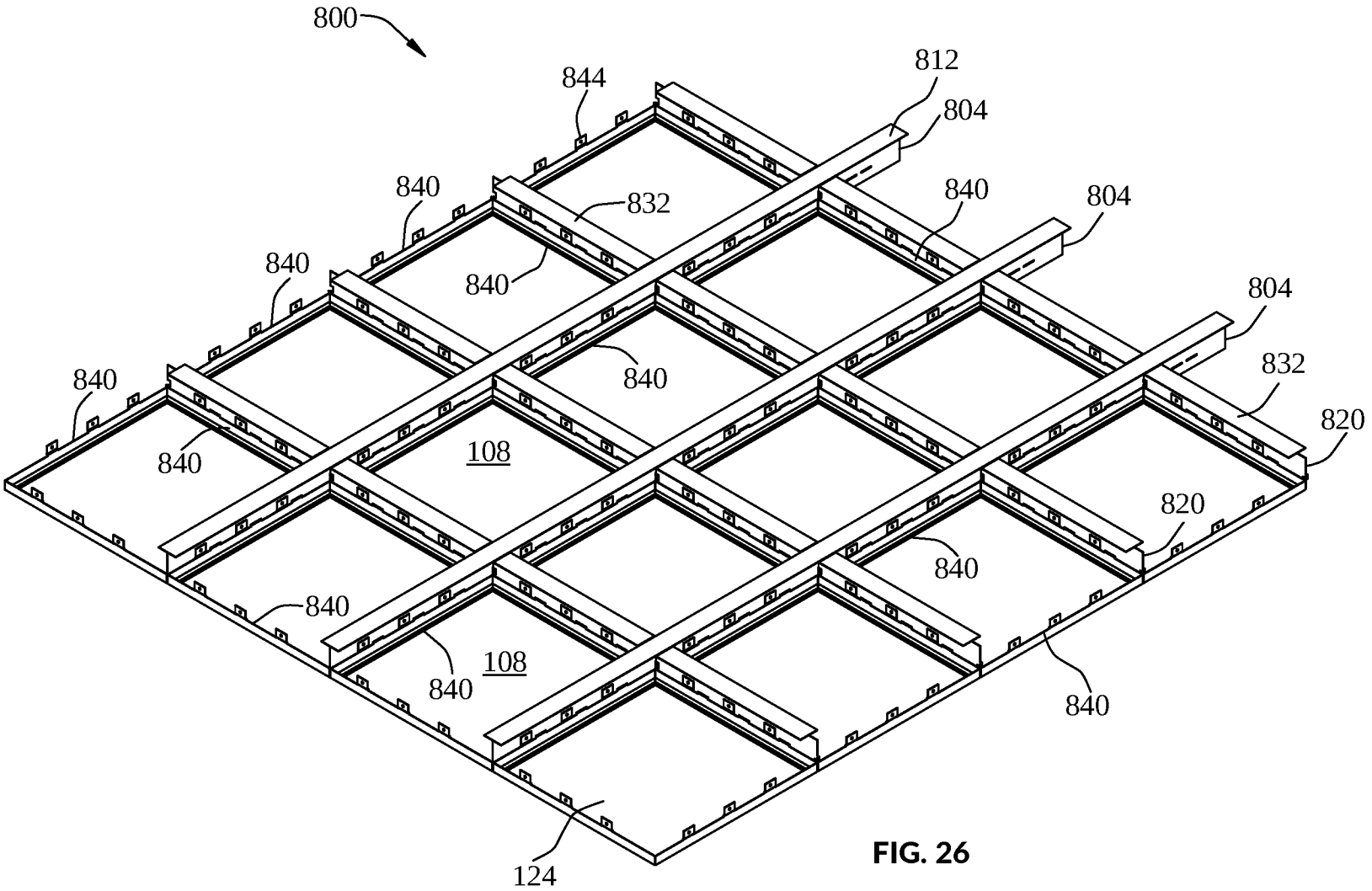
FIG. 26 is an isometric view of a ceiling grid system according to yet another embodiment of the present invention that is part of an overall suspended ceiling installed in a room.

Referring to FIG. 26, there illustrated is an isometric view of a ceiling grid system 800 according to yet another embodiment of the present invention. The ceiling grid system 800 is similar in many structural and functional aspects to the embodiment of the ceiling grid system 700 described hereinabove and illustrated in FIGS. 14-25. A primary difference between the ceiling grid systems 700 and 800 is related to the structure and function of the main runners and cross-runners. As described hereinabove, in the ceiling grid system 700 each of the main runners 704 and the cross-runners 720 comprises a fixed horizontal flange 712, 732, respectively, located at the bottom portion of the runner. The flange 712, 732 is configured to support a ceiling panel 108 and is also configured and operable to provide for stiffening of the main runner 704 and cross-runner 720. In comparison, in the ceiling grid system 800 of FIG. 26, each of the main runners 804 and the cross-runners 820 is T-shaped, in which the corresponding horizontal flange 812, 832, respectively, is positioned at the top portion of the runner 804, 820, thereby forming a T-runner. Similarly, these flanges 812, 832 are configured and operable to provide for stiffening of the main runner 804 and the cross-runner 820.

Similar to the ceiling grid system 700 of FIGS. 14-25, the ceiling grid system 800 of FIG. 26 includes a plurality of main runners 804 oriented parallel to each other and includes a plurality of cross-runners 820 oriented parallel to each other and perpendicular to the main runners 804. As mentioned, a primary function of the horizontal flanges 812, 832 on top of the T-runner is to stiffen the main runner 804 and the cross-runner 820 to maintain those runners in a straight-line position.

Both the main runners 804 and the cross-runner 820 are located within the interior of the ceiling grid system 800. The long peripheral edges of the ceiling grid system 800 in parallel to the main runner 804 are bordered by panel support members 840 that adjoin walls of the room. At least one of the short peripheral edges of the ceiling grid system 800 in parallel to the cross-runners 820 is bordered by panel support members 840 that adjoin walls of the room. The other opposing, short peripheral edge of the ceiling grid system 800 may be left open, instead of being bordered by either a cross-runner 820 or multiple panel support members 840, when the peripheral edge of a cornered opening 124 in parallel to the main runner 804 is shorter than the length of the panel support member 840.

Figure 27:
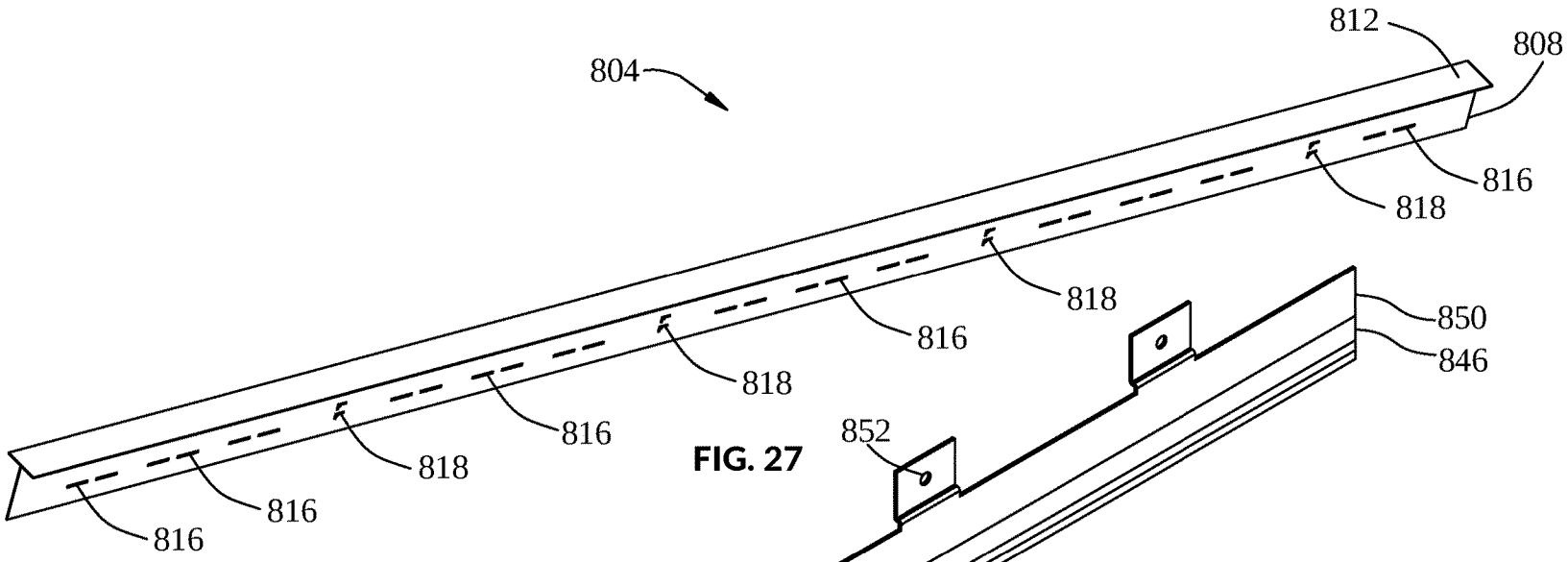
FIG. 27 is an isometric view of a main runner according to the embodiment of the present invention of FIG. 26.

Referring to FIG. 27, there illustrated is an isometric view of a main runner 804 according to the embodiment of the ceiling grid system 800 of FIG. 26. Like the main runner 704 in the ceiling grid system 700, each of the main runners 804 includes: (a) a vertical leg 808 that can be attached to the ceiling or floor joists using hanger clips, brackets, or wires; (b) a fixed horizontal flange 812 located on the top of the main runner 804; and (c) a plurality of slots 816. The slots 816 are formed therein at spaced apart intervals along a length of the main runner 804.

As described and illustrated in greater detail hereinafter, the slots 816 are operable to engage with corresponding S-shaped tabs 844 that are part of the panel support members 840. As a result, two opposing sides of the main runner 804 are operable to engage with two panel support members 840 with one panel support member 840 being disposed on each side of the main runner 804. Other holes 818 formed in the main runner 804 are configured to engage hook tabs 828 formed at ends of the cross-runner 820. Similar to the interlocking connections between holes 718 of the main runner and the hook tabs 728 of the cross-runner 720 in the embodiment 700 described hereinabove and illustrated in FIGS. 14-25, the interlocking connections between the holes 818 of the main runner 804 and hook tabs 828 of the cross-runner 820 connect the cross-runner 820 to the main runner 804 in the overall ceiling grid system 800.

Figure 28:
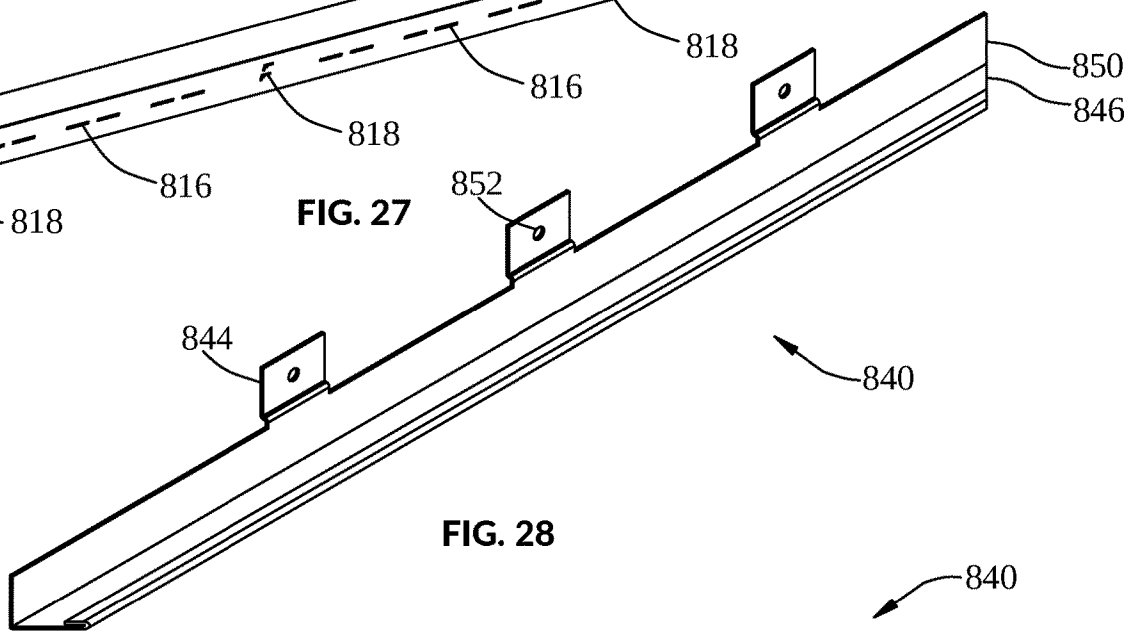
FIG. 28 is an isometric view of a panel support member according to the embodiment of the present invention of FIG. 26.
Figure 29:
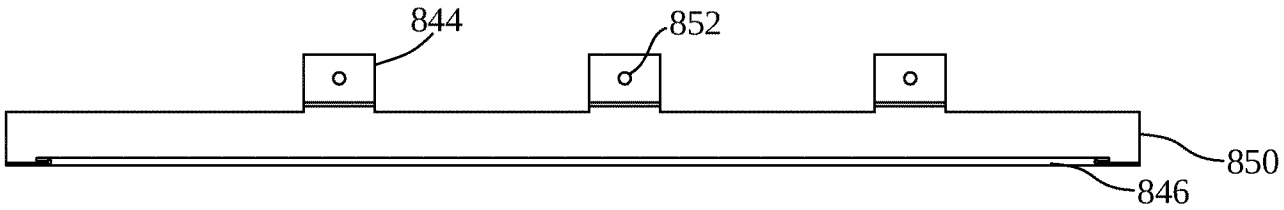
FIG. 29 is a sideview of the panel support member in FIG. 28 according to the embodiment of the present invention of FIG. 26.

Referring to FIGS. 28 and 29, there illustrated are an isometric view and a sideview, respectively, of a panel support member 840 according to the embodiment of the ceiling grid system of FIG. 26. The panel support member 840 has a plurality of S-shaped tabs 844 formed therein at spaced apart intervals along a length of the panel support member 840. Each of the tabs 844 has a small central hole 852 located in the center of the S-shaped tab 844. Similar to the S-shaped tabs 744 of the panel support member in the ceiling grid system 700, the holes 852 in the S-shaped tabs 844 are configured to enable a peripheral panel support member 840 to be fixed to a wall of the room. The S-shaped tab 844 is operable to engage with a corresponding one of the slots 816 in the main runner 804 or one of the slots 836 in the cross-runner 820.

The panel support member 840 also has a horizontal flange 846 and a vertical flange 850, both of which are formed therein along a length of panel support member 840. The horizontal flange 846 is configured to support a ceiling panel 108. The horizontal flange 846 of the panel support member 840 has a trapezoidal shape with the outermost peripheral edge at each end of the flange 846 being angled inwardly by 45 degrees with respect to the longest edge of the horizontal flange 846. As such, the corresponding flange 846 of each of two panel support members 840 located adjacent to each other in the ceiling grid system 800 form a right angle with respect to each other. One of these two panel support members 840 is configured to connect to a main runner 804 while the other panel support member 840 is configured to connect to a cross-runner 820.

Figure 30:
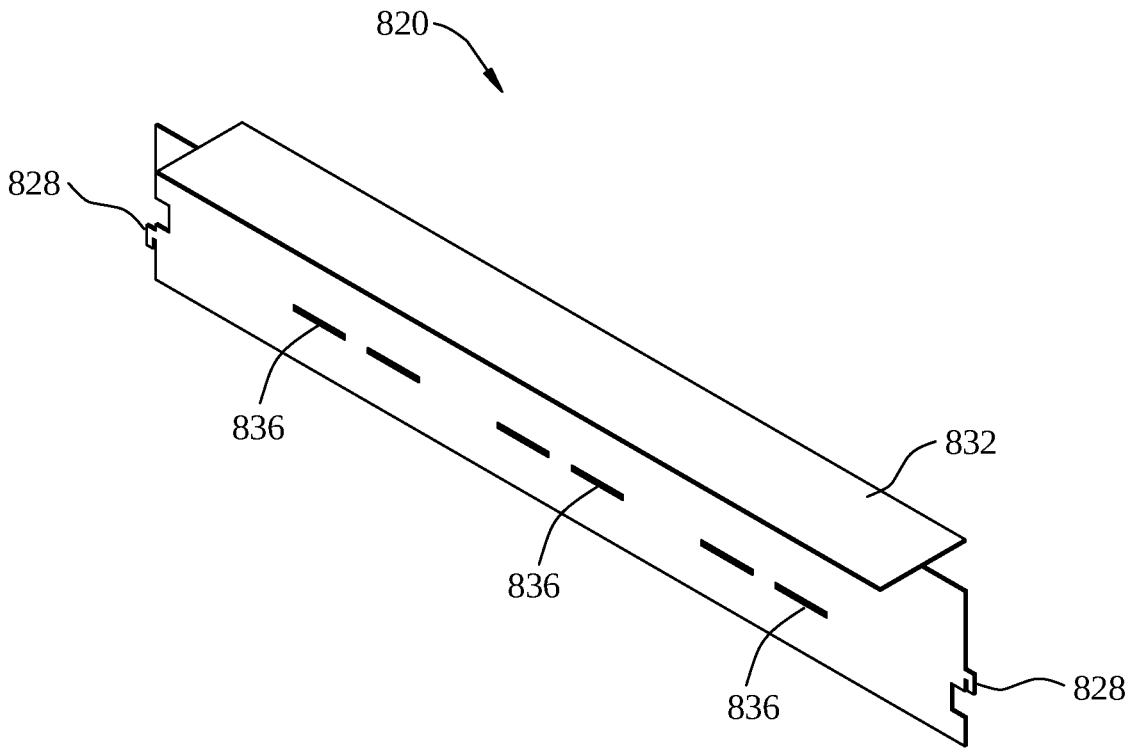
FIG. 30 is an isometric view of a cross-runner according to the embodiment of the present invention of FIG. 26.
Figure 31:
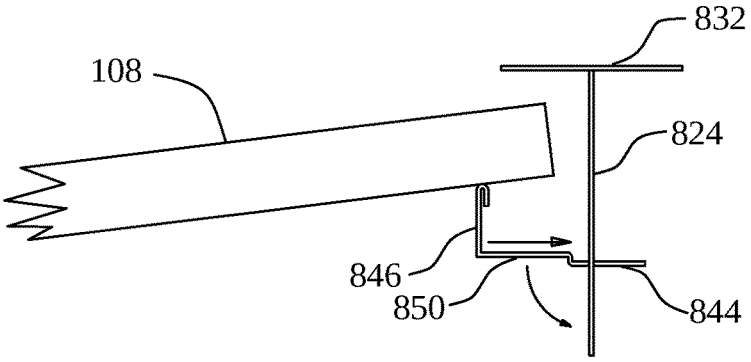
FIG. 31 is a sideview of a first ceiling panel to be mounted onto a flange of a first panel support member according to the embodiment of the present invention of FIG. 26.

Referring to FIGS. 30, there illustrated is an isometric view and a front view, respectively, of a cross-runner 820 according to the embodiment of the ceiling grid system 800 of FIG. 26. Similar to the main runner 804, each of the cross-runners 820 includes: (a) a vertical leg 824; (b) a fixed horizontal flange 832 located on the top of the cross-runner 820; and (c) a plurality of slots 836. The slots 836 are formed therein at spaced apart intervals along a length of the cross-runner 820 and operable to engage with corresponding S-shaped tabs 844 that are part of the panel support members 840 located on either side of the cross-runner 820. As a result, two sides of the cross-runner 820 are operable to engage with two panel support members 840 with one on each side of the cross-runner 840. The cross-runner 820 further includes hook tabs 828 located at ends of the cross-runner 820.

Referring to FIGS. 31 to 34, there illustrated is an exemplary embodiment of an assembling process of two ceiling panels 108 and two panel support members 840 to be mounted to a T-shaped main runner 804 or cross-runner 820 in the ceiling grid system 800. Although the T-runner in FIGS. 31-34 is labeled for the cross-runner 820, the assembling process is equally applicable for a main runner 804. The panel support member 840 has one end of a S-shaped tab 844 attached to the vertical flange 850 and the other end of a horizontal flange 846 that is configured to support a ceiling panel 108.

Figure 32:
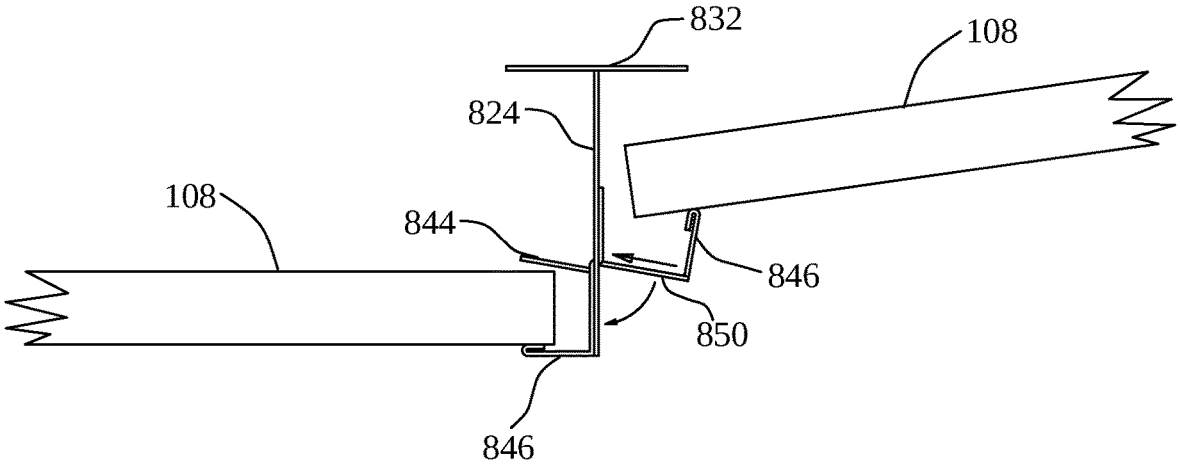
FIG. 32 is a sideview of a second ceiling panel to be mounted onto a flange of a second panel support member according to the embodiment of the present invention of FIG. 26.

FIG. 32 illustrates an assembling step of a first ceiling panel 108 and a first panel support member 840 to be mounted to the T-runner. This is performed by rotating the panel support member 840 so that its S-shaped tabs 844 are generally moving towards a horizontal position. The S-shaped tabs 844 of the panel support member 840 are then inserted into corresponding slots of the T-runner. The ceiling panel 108 is inserted into the ceiling opening 124 to rest on top of the horizontal flange 846 of the panel support member 840.

Figure 33:
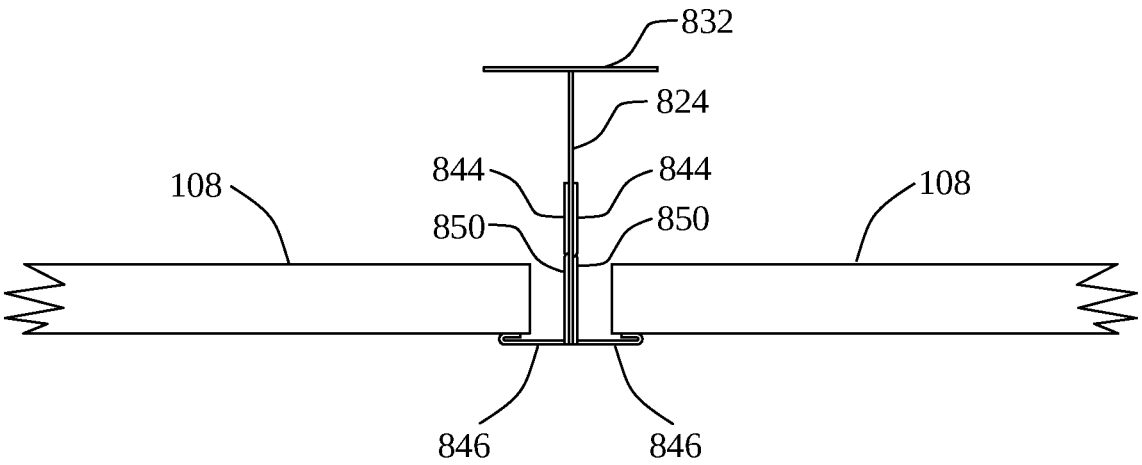
FIG. 33 is a sideview of two ceiling panels supported on the two flanges of panel support members according to the embodiment of the present invention of FIG. 26.

FIG. 33 illustrates an assembling step of a second ceiling panel 108 and a second panel support member 840 to be mounted to the T-runner, where the first panel support member 840 is interlocked to the T-runner and the horizontal flange 846 of the first panel support member 840 is in the horizontal position supporting the first ceiling panel 108 within an adjacent opening 124 in the ceiling grid system 800.

Figure 34:
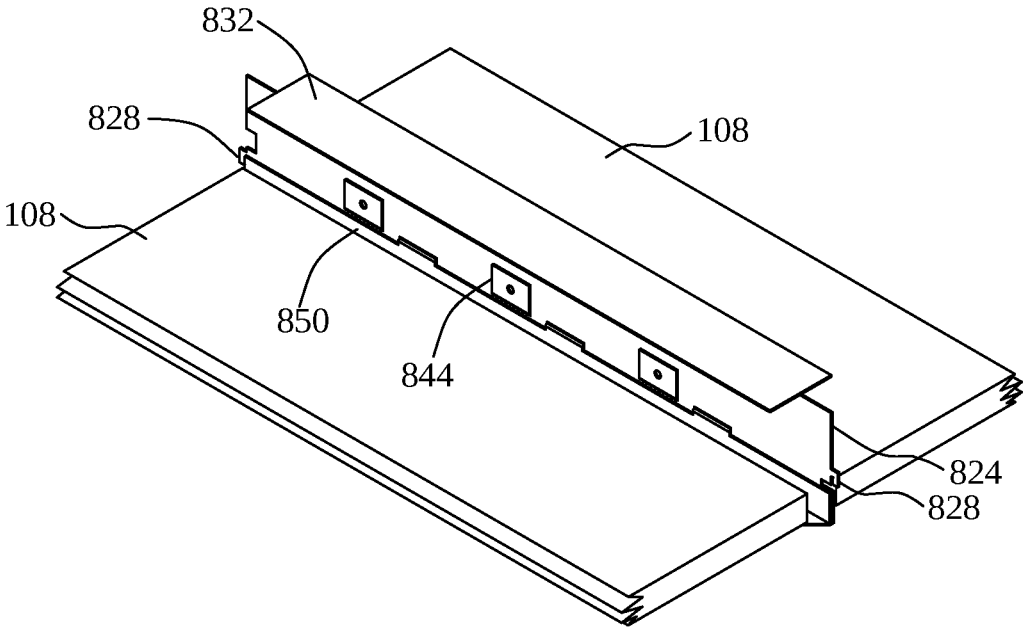
FIG. 34 is an isometric view of the two ceiling panels supported on the two flanges of the panel support members according to the embodiment of the present invention of FIG. 26.

FIG. 34 illustrates two panel support members 840 interlocked to each side of two sides of the T-runner. The two ceiling panels 108 are supported on two horizontal flanges 846 of the two panel support members 840.

Referring to FIG. 34, there illustrated is an isometric view of the two ceiling panels 108 supported by the two horizontal flanges of the panel support members 840, which are interlocked to either side of a cross-runner 820. As shown in FIG. 34, similar to the ceiling grid system 700, in this horizontal position, the horizontal flanges 846 of the two panel support members 840 are located in the same horizontal plane. This allows for the proper horizontal leveling of the ceiling panels 108 within the corresponding openings 124. Also, this proper horizontal positioning of the horizontal flanges 846 of the panel support members 840 is achieved by the respective slot engagements in the main runner 804 or slot engagements in the cross-runner 820 with the S-shaped tabs 844 in the two panel support members 840.

Referring again to FIGS. 31 to 34, the panel support members 840 can be easily rotated to install or to remove the ceiling panels 108 within the ceiling grid system 800. In use, to install a panel support member 840 within an opening 124 in the ceiling grid system 800 of FIG. 26, the vertical flange 850 of the panel support member 840 is rotated to a horizontal position, then the S-shaped tabs 844 are inserted into corresponding slots 816 (main runner) or 836 (cross-runner) in the T-runner. A ceiling panel 108 is inserted to the ceiling opening 124 to rest on top of the horizontal flange 846 of the panel support member 840 followed by rotating the vertical flange 850 of the panel support member 840 back to a vertical position to interlock with the T-runner and to have the ceiling panel 108 supported on the horizontal flange 846 of the panel support member 840.

When the first ceiling panel 108 is already positioned within an adjacent opening 124 and is supported by the first panel support member 840 which is interlocked to the T-runner in the ceiling grid system 800, the mounting of the second panel support member 840 and the second ceiling panel 108 is performed by rotating the second panel support member within the corresponding slots of the T-runner upward slightly so that the second ceiling panel 108 can be inserted in to have one end resting on top of the horizontal flange 846 of the second panel support member 840. The second panel support member 840 is rotated back so that the vertical flange 850 is in the vertical position to interlock with the T-runner. The ceiling panel 108 can then be adjusted or maneuvered so that it rests on the flange of associated runner 804 or 820. In contrast, to remove a panel support member 840 from an opening 124 within the ceiling grid system 800 of FIG. 26, the panel support member 840 is simply rotated upwards inside of the opening 124 before pulling the S-shaped tabs 844 from the slots 816 of the main runner or from the slots 836 of the cross-runner. This will disengage the S-shaped tabs 844 from the slots of the T-runner. As such, this will allow for a relatively quick and easy removal of a ceiling panel 108 from within an opening 124 of the ceiling grid system 800. Also, similar to the ceiling grid system 700 of the embodiment described hereinabove with respect to FIGS. 14-25, someone installing or removing a ceiling panel 108 with respect its corresponding opening 124 within the ceiling grid system 800 of exemplary embodiments of the present invention need only raise the ceiling panel 108 to no higher than the top level of the ceiling grid system 800.

Various embodiments of the ceiling grid system 100, 700, and 800 of the present invention have been described hereinabove as having a rectilinear shape and with standard size openings to accommodate standard size ceiling panels (e.g., two feet by two feet, two feet by four feet, etc.). However, oftentimes the room in which the suspended or drop ceiling will be installed is of a size in which the ceiling panels must have a size that is non-standard. As such, to accommodate this situation, the ceiling grid system 100, 700, and 800 must also have the various runners and panel support members be of a certain size. It should be apparent to one of ordinary skill in the art in light of the teachings herein how to properly size the various runners and panel support members to achieve the benefits of the various embodiments of the present invention.

Also, oftentimes the room in which the suspended or drop ceiling will be installed is not of a square or rectangular shape. That is, not all of the walls in the room are at right angles to each other. Instead, at least one of the walls is at an angle other than a right angle (e.g., an acute or obtuse angle) to two other adjacent and adjoining walls. As such, to accommodate this situation, the ceiling panels 108 must have a size that is non-standard. Also, the ceiling grid system 100, 700, and 800 must also have certain ones of the various runners and panel support members be of a certain size and be angled as well. Thus, it may be necessary to utilize L-shaped brackets and/or other structural devices within the ceiling grid system 100, 700, and 800 of embodiments of the present invention to properly account for the non-right-angled wall(s) in the room. It should be apparent to one of ordinary skill in the art in light of the teachings herein how to properly size the various runners and panel support members and how to implement the L-shaped brackets and/or other structural devices to achieve the benefits of the various embodiments of the present invention.

The terminology used herein is for the purpose of describing particular embodiments of the invention only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the invention is provided in detail in connection with only a limited number of embodiments, it should be readily understood that the invention is not limited to such disclosed embodiments. Rather, the invention can be modified to incorporate any number of variations, alterations, substitutions, or equivalent arrangements not heretofore described, but which are commensurate with the spirit and scope of the invention. Additionally, while various embodiments of the invention have been described, it is to be understood that the exemplary embodiments may include only some of the described exemplary aspects. Accordingly, the invention it not to be seen as limited by the foregoing description but is only limited by the scope of the appended claims.

What is claimed is:

1. A ceiling grid system for use as part of a suspended ceiling having a plurality of ceiling panels, the ceiling grid system being configured to hold each one of the ceiling panels in a predetermined position within the suspended ceiling when the suspended ceiling is installed in a physical space such as a room, the ceiling grid system comprising:

a plurality of main runners configured to attach to a support structure in the physical space, at least one of the main runners including a flange configured to stiffen the main runner to maintain the main runner in a straight-line position, at least one of the main runners including a plurality of slots located at periodically spaced intervals along a length of the main runner, wherein the flange is located at one of a top of the main runner or a bottom of the main runner, and wherein the flange when located at the bottom of the main runner is configured to support one of the ceiling panels;

a plurality of cross-runners oriented transverse to the plurality of main runners thereby forming a two-dimensional array having a plurality of openings and being disposed in a horizontal plane in the physical space, at least one of the cross-runners including a flange configured to stiffen the cross-runner to maintain the cross-runner in a straight-line position, at least one of the cross-runners including a plurality of slots located at periodically spaced intervals along a length of the cross-runner, wherein the flange is located at one of a top of the cross-runner or a bottom of the cross-runner, and wherein the flange when located at the bottom of the cross-runner is configured to support one of the ceiling panels;

a plurality of panel support members, each one of the panel support members connected with a predetermined one of the main runners or a predetermined one of the cross-runners, the panel support member including a flange configured to support one of the ceiling panels and including a plurality of tabs located at periodically spaced intervals along a length of the panel support member, each one of the tabs configured to interlock with a corresponding one of the slots in the main runner or a corresponding one of the slots in the cross-runner to form an interlocking tab and slot connection;

wherein the main runners and the cross-runners are configured to attach to each other and to be fixed in the horizontal plane in the physical space;

wherein each one of the openings defines a corresponding one of the predetermined positions within the suspended ceiling in which a corresponding ceiling panel is disposed; and wherein each one of the panel support members is movable in a rotatable manner with respect to the predetermined one of the main runners or the predetermined one of the cross-runners to facilitate a connection or disconnection of the panel support member with the predetermined one of the main runners or the predetermined one of the cross-runners to thereby facilitate an installation or removal of one of the ceiling panels with respect to its predetermined position within the suspended ceiling.

2. The ceiling grid system of claim 1, wherein the panel support member is rotatable with respect to the main runner or to the cross-runner between two positions, a first one of the two positions being a panel support position in which the panel support member supports one of the ceiling panels, wherein in the panel support position each one of the tabs engages with a corresponding one of the slots, and a second one of the two positions being a panel non-support position in which the panel support member does not support one of the ceiling panels, and wherein in the panel non-support position each one of the tabs does not engage with any one of the slots.

3. The ceiling grid system of claim 1, wherein each one of the plurality of tabs comprises an S-shaped tab.

4. The ceiling grid system of claim 1, wherein each one of the main runners further comprises a plurality of holes, wherein each one of the cross-runners further comprises at least two hook tabs, each one of the hook tabs located at an end of the cross-runner, and wherein the main runners and the cross-runners are configured to attach to each other by interlocking each one of the hook tabs in the cross-runner with a corresponding one of the holes in the main runner.

5. The ceiling grid system of claim 1, wherein the flange of the main runner and the flange of the cross-runner are both oriented horizontally in a plane in which a bottom surface of each one of the ceiling panels is oriented horizontally in.

6. The ceiling grid system of claim 1, wherein the flange of the main runner and the flange of the cross-runner are both oriented horizontally in a first plane located above a second plane in which a bottom surface of each one of the ceiling panels is oriented horizontally in.

7. The ceiling grid system of claim 1, wherein when each of the tabs is interlocked with the corresponding one of the slots in the main runner or with the corresponding one of the slots in the cross-runner to connect the panel support member with the main runner or with the cross-runner, the panel support member is in the first position with respect to the main runner or to the cross-runner to support one of the ceiling panels, and when each one of the tabs of the panel support member is not interlocked with the corresponding one of the slots in the main runner or with the corresponding one of the slots in the cross-runner, the panel support member is in the second position with respect to the main runner or to the cross-runner so as not to support one of the ceiling panels.

8. The ceiling grid system of claim 7, wherein each one of the plurality of tabs comprises an S-shaped tab.

9. A ceiling grid system for use as part of a suspended ceiling having a plurality of ceiling panels, the ceiling grid system being configured to hold each one of the ceiling panels in a predetermined position within the suspended ceiling when the suspended ceiling is installed in a physical space such as a room, the ceiling grid system comprising:

a plurality of main runners configured to attach to a support structure in the physical space, at least one of the main runners including a flange configured to stiffen the main runner to maintain the main runner in a straight-line position, at least one of the main runners including a plurality of connections of a first type, wherein the flange is located at one of a top of the main runner or a bottom of the main runner, and wherein the flange when located at the bottom of main runner is configured to support one of the ceiling panels;

a plurality of cross-runners oriented transverse to the plurality of main runners thereby forming a two-dimensional array having a plurality of openings and being disposed in a horizontal plane in the physical space, at least one of the cross-runners including a flange configured to stiffen the cross runner to maintain the cross-runner in a straight-line position, at least one of the cross-runners including a plurality of connections of the first type, wherein the flange is located either at one of a top of the cross-runner or a bottom of the cross-runner, and wherein the flange when located at the bottom of cross-runner is configured to support one of the ceiling panels;

a plurality of panel support members, each one of the panel support members connected with a predetermined one of the main runners or a predetermined one of the cross-runners, the panel support member including a flange configured to support one of the ceiling panels and including a plurality of connections of a second type that is complementary to the plurality of connections of the first type;

wherein the main runners and the cross-runners are configured to attach to each other and to be fixed in the horizontal plane in the physical space;

wherein each one of the openings defines a corresponding one of the predetermined positions within the suspended ceiling in which a corresponding ceiling panel is disposed;

wherein each one of the panel support members is movable in a rotatable manner with respect to the predetermined one of the main runners or the predetermined one of the cross-runners to facilitate a connection or disconnection of the panel support member with the predetermined one of the main runners or the predetermined one of the cross-runners to thereby facilitate an installation or removal of one of the ceiling panels with respect to its predetermined position within the suspended ceiling; and wherein at least one of the panel support members is movable in the rotatable manner by engaging the connections of the second type of the panel support member with the connections of the first type of the main runner or the connections of the first type of the cross-runner to form a rotatable connection such that the panel support member is rotatable with respect to the main runner or to the cross-runner.

10. The ceiling grid system of claim 9, wherein the at least one panel support member is rotatable with respect to the main runner or to the cross-runner between at least two positions, a first one of the at least two positions being a panel support position in which the panel support member supports one of the ceiling panels, and a second one of the at least two positions being a panel non-support position in which the panel support member does not support one of the ceiling panels.

11. The ceiling grid system of claim 9, wherein each one of the main runners further comprises a plurality of holes and each one of the cross-runners further comprises at least two hook tabs, each one of the hook tabs located at an end of the cross-runner, and wherein the main runners and the cross-runners are configured to attach to each other by interlocking each one of the hook tabs in the cross-runner with a corresponding one of the holes in the main runner.

12. The ceiling grid system of claim 9, wherein the connection of the first type comprises a slot and the connection of the second type comprises a tab.

13. The ceiling grid system of claim 9, wherein the flange of the main runner and the flange of the cross-runner are both oriented horizontally in a plane in which a bottom surface of each one of the ceiling panels is oriented horizontally in.

14. The ceiling grid system of claim 9, wherein the flange of the main runner and the flange of the cross-runner are both oriented horizontally in a first plane that is located above a second plane in which a bottom surface of each one of the ceiling panels is oriented horizontally in.

15. A runner for use in a ceiling grid system that is part of a suspended ceiling having a plurality of ceiling panels, the ceiling grid system being configured to hold each one of the ceiling panels in a predetermined position within the suspended ceiling, the runner comprising:

a fixed portion configured to attach to a support structure, the fixed portion including a first support flange configured to stiffen the runner to maintain the runner in a straight-line position, the fixed portion including a first connection portion having at least two connections of a first type, wherein the connections of the first type are spaced apart along a length of the first connection portion, wherein the first support flange is located at one of a top of the fixed portion or a bottom of the fixed portion, and wherein the first support flange when located at the bottom of the fixed portion is configured to support one of the ceiling panels; and a panel support portion configured to attach to the fixed portion, the panel support portion including a second support flange configured to support one of the ceiling panels and including a second connection portion having at least two connections of a second type that is complementary to the connections of the first type, the connections of the second type being spaced apart along the second connection portion;

wherein the panel support portion engages the fixed portion to form a rotatable connection, the rotatable connection configured to allow rotation of the panel support portion with respect to the fixed portion between at least two rotational positions of the panel support portion with respect to the fixed portion, a first one of the rotational positions being a panel support position to support the ceiling panel within the ceiling grid system and a second one of the rotational positions being a panel non-support position to facilitate removal of the ceiling panel from within the ceiling grid system.

16. The runner of claim 15, wherein the panel support portion engages the fixed portion in an interlocking connection.

17. The runner of claim 15, wherein the connections of the first type and the connections of the second type are spaced apart equally with respect to each other.

18. The runner of claim 15, wherein the first connection portion of the fixed portion is straight, and wherein the second connection portion of the panel support portion is straight.

19. The runner of claim 18, wherein the connection of the first type comprises a slot, and wherein the connection of the second type comprises a tab.

20. The runner of claim 19, wherein the tab comprises an S-shaped tab.

* * * * *